US010374347B2

(12) United States Patent
Bianca et al.

(10) Patent No.: US 10,374,347 B2
(45) **Date of Patent: *Aug. 6, 2019**

(54) MULTIPLE PIECE CONTACT FOR AN ELECTRICAL CONNECTOR

(71) Applicant: Carlisle Interconnect Technologies, Inc., St. Augustine, FL (US)

(72) Inventors: Giuseppe Bianca, Playa Vista, CA (US); Leonid Foshansky, San Diego, CA (US)

(73) Assignee: Carlisle Interconnect Technologies, Inc., St. Augustine, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/918,603

(22) Filed: Mar. 12, 2018

(65) Prior Publication Data

US 2018/0205167 A1 Jul. 19, 2018

Related U.S. Application Data

(63) Continuation of application No. 15/376,891, filed on Dec. 13, 2016, now Pat. No. 9,917,390.

(51) Int. Cl.

| | |
|---|---|
| ***H01R 13/11*** | (2006.01) |
| ***H01R 13/187*** | (2006.01) |
| *H01R 13/20* | (2006.01) |

(52) U.S. Cl.

CPC ..... *H01R 13/111* (2013.01); *H01R 13/187* (2013.01); *H01R 13/20* (2013.01)

(58) Field of Classification Search

CPC ..... H01R 13/111

USPC ..... 439/889, 843, 845, 851, 856

See application file for complete search history.

(56) References Cited

U.S. PATENT DOCUMENTS

| | | | | |
|---|---|---|---|---|
| 4,275,948 | A | 6/1981 | Gallusser et al. | |
| 4,447,110 | A * | 5/1984 | Punako | H01R 13/187 439/843 |
| 4,461,530 | A | 7/1984 | Brush, Sr. et al. | |
| 4,461,531 | A * | 7/1984 | Davis | H01R 43/26 439/843 |
| 4,621,887 | A | 11/1986 | Piscitelli et al. | |
| 4,734,064 | A | 3/1988 | Knapp et al. | |
| 4,780,097 | A * | 10/1988 | Piscitelli | H01R 13/187 29/510 |
| 5,419,723 | A | 5/1995 | Villiers et al. | |

(Continued)

OTHER PUBLICATIONS

Fourteen-page Internation Search Report and Written Opion dated Mar. 6, 2018 for PCT/U52017/065770.

*Primary Examiner* — Travis S Chambers

(74) *Attorney, Agent, or Firm* — Wood Herron & Evans LLP

(57) ABSTRACT

An electrical connector contact has a body for receiving a conductor and for receiving a male pin contact. A spring is configured for engaging the pin contact and includes a plurality of spring fingers positioned for forming a bore with the spring fingers bent radially inwardly and configured for securing a pin in engagement with the body. A sleeve is configured for engaging the body to overlie the spring. Indentations are formed in the body at discrete positions around the body and extend radially inwardly into the pin section. The spring includes tongues extending radially inwardly and configured for extending into the indentations for securing the spring with the body.

19 Claims, 17 Drawing Sheets

(56) References Cited

U.S. PATENT DOCUMENTS

| | | | | |
|---|---|---|---|---|
| 6,250,974 | B1 | 6/2001 | Kerek | |
| 6,264,508 | B1 | 7/2001 | Lehmann | |
| 6,475,039 | B1 * | 11/2002 | Despouys | H01R 13/11 439/843 |
| 7,850,495 | B2 | 12/2010 | Niles et al. | |
| 8,465,332 | B2 | 6/2013 | Hogan et al. | |
| 8,851,940 | B2 * | 10/2014 | Friedhof | H01R 13/111 439/843 |
| 8,876,562 | B2 | 11/2014 | Glick et al. | |
| 9,325,095 | B2 | 4/2016 | Glick et al. | |
| 9,917,390 | B1 * | 3/2018 | Bianca | H01R 13/111 |
| 2013/0017739 | A1 * | 1/2013 | Glick | H01R 13/187 439/842 |
| 2014/0017960 | A1 | 1/2014 | Friedhof et al. | |
| 2015/0126076 | A1 | 5/2015 | Horiuchi et al. | |

* cited by examiner

MULTIPLE PIECE CONTACT FOR AN ELECTRICAL CONNECTOR

CROSS-REFERENCE TO RELATED APPLICATION

This application is a Continuation application of U.S. application Ser. No. 15/376,891, entitled MULTIPLE PIECE CONTACT FOR AN ELECTRICAL CONNECTOR, filed Dec. 13, 2016 and issued as U.S. Pat. No. 9,917,390. The contents of this related Application are hereby expressly incorporated by reference herein in their entireties.

FIELD OF THE INVENTION

The present invention relates generally to electrical connectors and more specifically to a socket contact for receiving a mating pin contact for forming an electrical connection.

BACKGROUND OF THE INVENTION

Electrical contacts are present in all avionics, military and aerospace equipment environment such as in helicopters, missiles and planes. Such equipment has hundreds or even thousands of electrical connections that must be made between electronic power supplies, sensors, activators, circuit boards, bus wiring, wiring harnesses, to provide the electrical pathways or highways needed to transport electricity in the form of control signals and power. The hardware reliability requirements for operating in an avionics environment are stringent as a failure can have catastrophic consequences. As such, the electrical components and circuitry, as well as the connectors and contacts therein employed to electrically connect these items, must work in a wide range and wide variety of environmental conditions such as mechanical, vibration, wide temperature ranges, humidity and corrosive elements, etc.

For example, military standards (or mil specs) for aircraft avionics equipment require that connector contacts be able to mate and unmate hundreds of times with the respective other contact of the connector without a failure during all anticipated environmental and mechanical conditions. In addition, the contact assemblies must be protected to withstand repeated handling without significant distortion or damage to the interconnecting parts which could lead to a lack of electrical continuity across the connector.

Examples of socket contacts for connectors that are suitable for such uses are illustrated in U.S. Pat. Nos. 6,250,974 and 8,851,974. which include a defined female socket have a cylindrical mating portion or spring defined by cantilever beams or spring fingers. A male contact portion or pin is inserted into the female contact. The spring fingers are formed and bent to define the socket having an inner diameter less than the outer diameter of the pin. The fingers are configured to flex apart to receive the pin and to then bear against the pin under the spring force for a good electrical contact. Such connector contacts must be able to stand up to significant forces in use. One test for such contacts to ensure the fingers have enough elastic flex is referred to as a probe damage test. This test inserts a pin in to the socket at a specified depth and hangs a weight on the pin to deflect the spring to its maximum allowable distance. Then the socket is rotated 360 degrees in order to flex all the springs to their maximum deflection. The socket must be able to pickup a specified weight, therefore ensuring the springs have not deflected beyond the designed intent.

In order to ensure electrical continuity in connectors, some such connectors are commonly formed out of a single piece of material. However, there are drawbacks associated with using the same material to manufacture an entire connector. For example, in manufacturing a socket contact, the front end must have high yield strength to avoid permanent deformation when the socket fingers are deflected (e.g., during mating with a corresponding pin), and the back end must be very ductile to allow permanent deformation without cracking (e.g., during crimping around a conductor). Because materials that have a high yield strength are (generally) not very ductile, and vice versa, it is difficult to manufacture an optimal socket contact out of a single piece of material.

In an effort to overcome this drawback, multi-piece socket contact assemblies have been manufactured. Such a socket contact includes multiple pieces, including a socket body and a spring body. The spring body, during assembly, is press fit onto the socket body. The drawback of such an assembly, however, is that during periods of high vibration, the spring body has a tendency to move in relation to the socket body. While the movement may be minimal (e.g., not resulting in the disassembly of the socket contact), it can be enough to cause fretting, or friction, which can create of a non-conductive barrier. If a non-conductive barrier is formed, the electrical continuity of the conductor is compromised.

To secure the spring body, such contacts often use hoods or sleeves that fit over the spring body and socket body to secure the assembly together. In various designs, the socket body is machined all the way around the socket body to have features which further secure the spring body thereon. Still further, the sleeves of prior art designs must be machined or otherwise formed to have additional features that engage the spring body to secure it on the socket body and/or engage the spring fingers to prevent over flexing or over extension.

As may be appreciated, the additional machining of the socket body and the required formation of additional features in the sleeve, increases the number of steps that are required in forming the multipiece contact. This in turn lowers the throughput in the formation process, and it essentially increases the overall cost of the contact.

Thus, it is desirable to provide a multiple piece electrical contact that addresses various of the drawbacks, can be manufactured more efficiently and cost effectively and still stands up the rigorous environment that is encountered in the use of such contacts.

BRIEF DESCRIPTION OF THE DRAWINGS

The accompanying drawings, which are incorporated in and constitute a part of this specification, illustrate embodiments of the invention and, together with a general description of the invention given below, serve to explain the principles of the invention.

DETAILED DESCRIPTION OF EMBODIMENTS OF THE INVENTION

Figure 1:
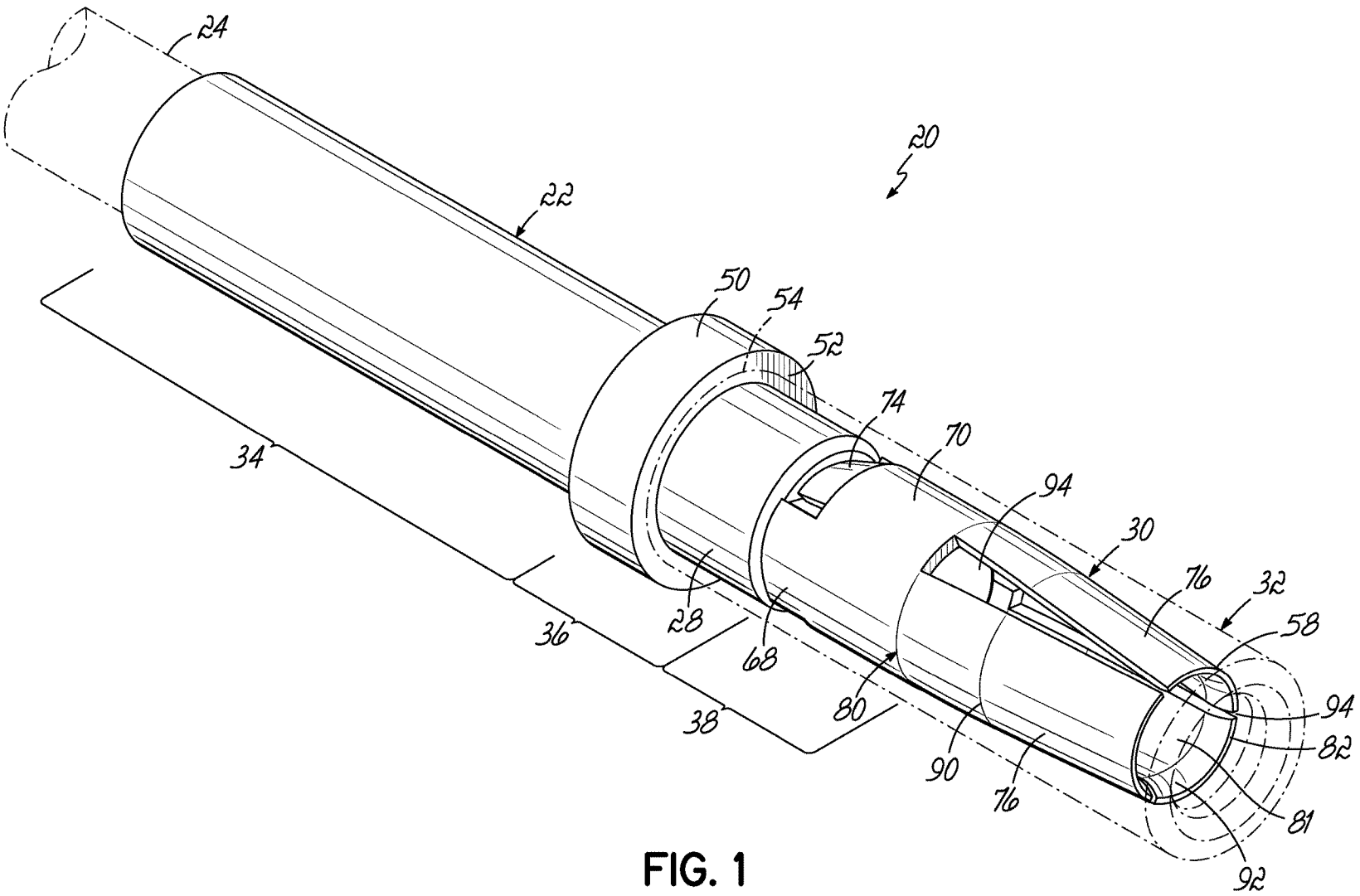
FIG. 1 is perspective view of a contact in accordance with an embodiment of the invention.

FIG. 1 illustrates one embodiment of a multiple piece electrical connector contact of the invention. Contact 20 forms a female contact or portion of an overall larger electrical connector assembly and couples with a suitable cable or conductor. A male contact or portion of the connector assembly, including a pin (not shown) coupled with another cable or conductor generally engages with the female contact portion as illustrated in FIG. 1 for the electrical connection.

Figure 3:
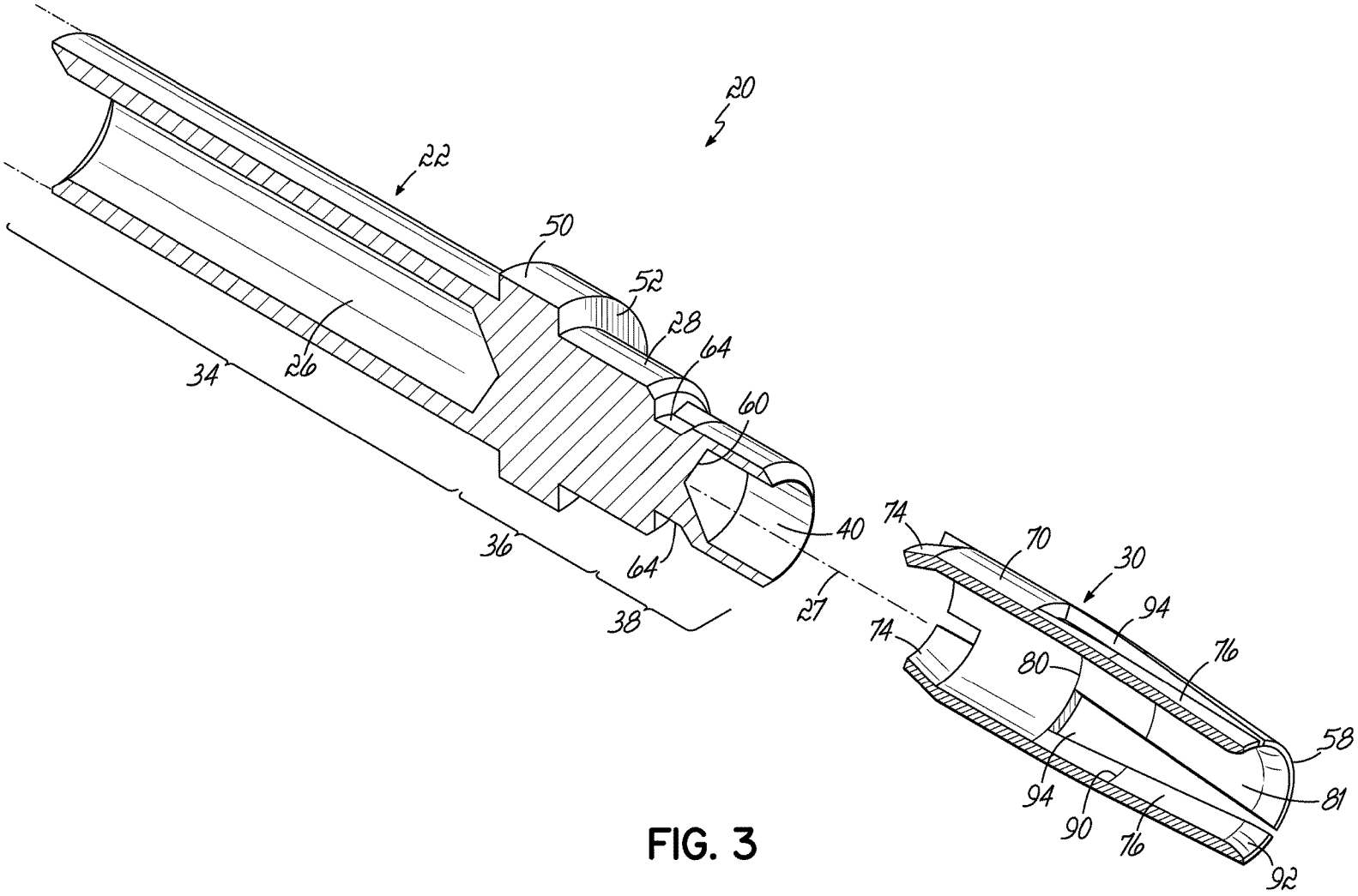
FIG. 3 is an exploded view, in partial cross-section, of the contact of FIG. 1 in accordance with an embodiment of the invention.

More specifically, referring to FIG. 1, contact 20 includes multiple pieces or sections that are assembled together to form the complete contact 20. Specifically, contact 20 includes a solid contact body 22 that engages with a suitable wire or cable 24. Generally the exposed conductor of the cable 24 is inserted into body 22. Body 22, as illustrated in FIG. 3, has a bore section which forms an internal bore 26 that is configured for receiving the inner conductor (not shown) of cable 24. Body 22 and bore 26 may be configured and sized to couple with various different sizes of cables and conductors as appropriate and the invention is not limited to the size of the cable nor the size of a particular contact. An inner conductor of cable 24 may be appropriately secured in the bore 26 by known methods, such as by crimping or soldering, etc.

Figure 4:
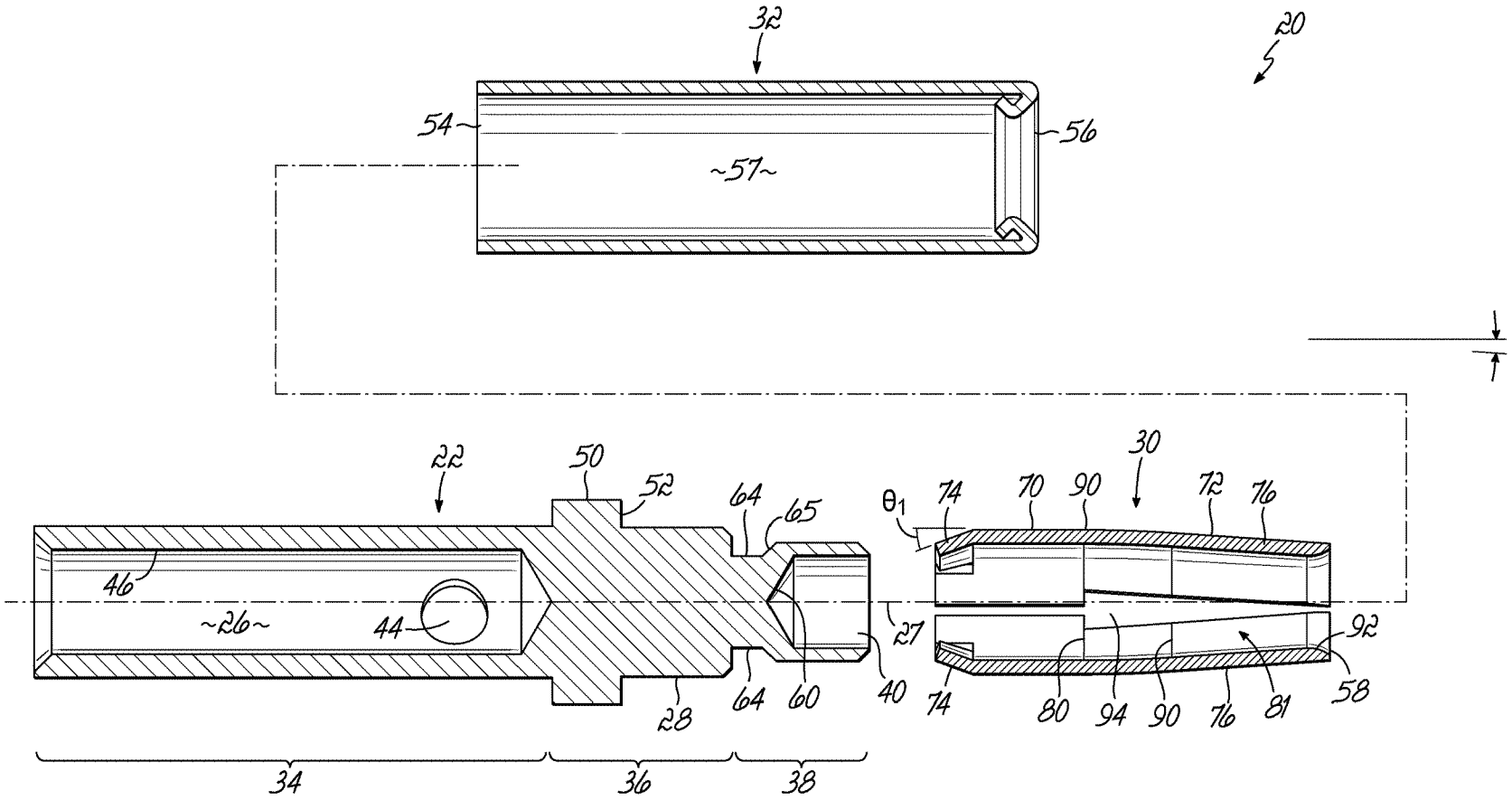
FIG. 4 is an exploded side view, in partial cross-section, of the contact of FIG. 1 in accordance with an embodiment of the invention.
Figure 5:
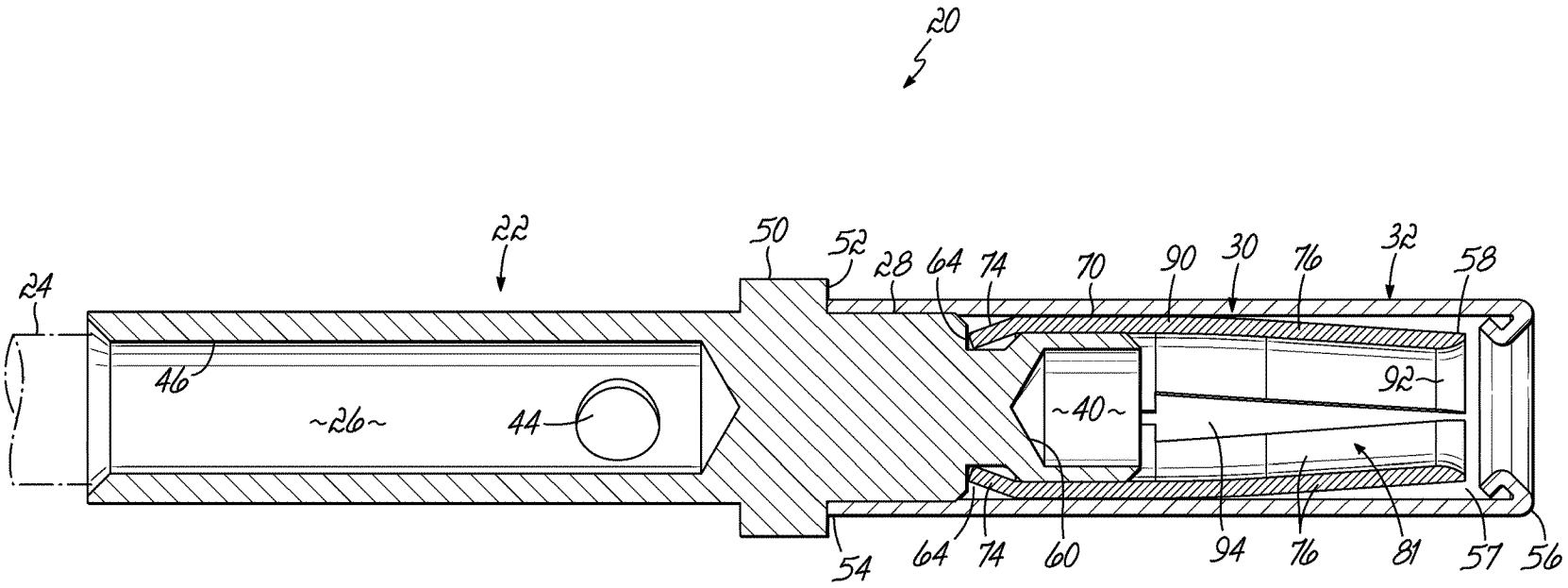
FIG. 5 is a side cross-sectional view view of the contact of FIG. 1 in accordance with an embodiment of the invention.

Forwardly of the bore 26 and bore section 34, body 22 includes a solid section 36 having features and a construction as discussed herein for engaging a separate spring piece or spring 30 and a sleeve piece or sleeve 32 for forming the multiple piece contact as described herein. As illustrated in FIG. 4, to form the multiple piece contact 20, body 22, spring 30, and sleeve 32 are all axially aligned and connected together to form the contact. First, the spring 30 is secured to body 22 and then sleeve 32 overlies the spring 30 and a portion of body 22. FIG. 5 illustrates a cross-sectional view of the assembled multiple piece contact 20 in accordance with one embodiment of the invention.

Referring again to FIGS. 3 and 4, body 22 includes the bore section or conductor section 34 that defines bore 26. Forward of the conductor section 34 is the solid section 36 configured for engaging and securing the other pieces of the multiple piece contact as described herein. Forward of the solid section 36 is a pin section 38 that also defines an internal bore 40 for receiving the tip of a male mating pin or male contact (not shown) that will be engaged with contact 20 in a conventional fashion to form a complete connector.

Body 22 may be formed of a suitable conductive metal, such as brass, a copper alloy, or aluminum, for example. Other suitable metals might also be utilized. As illustrated in FIG. 4, the conductor section 34 might include one or more apertures 44 formed therein and allowing access into bore 26, such as for the flow of a conductive coating or plating material in the bore. For example, the internal surface 46 of bore 26 may be gold plated for improved electrical conduction. As noted, a conductor inserted into bore 26 might be appropriately secured, such as by being crimped or being soldered.

In accordance with one embodiment of the invention, the body is stamped with cold head equipment rather than being machined. The solid section 36 of the body 22 may be formed to have an outer diameter essentially equal to the outer diameter of the conductor section 34 although not required. A collar 50 is also formed in the solid section 36. The collar 50 may be cold formed into a portion of the solid section 36 and essentially is formed to have a larger outer diameter than the rest of the solid section. The collar 50 is positioned on solid section 36 more toward the conductor section 34 and rearwardly of pin section 38. Collar 50 having a larger diameter then essentially forms a shoulder 52 on the solid section that is positioned rearwardly of pin section 38. The shoulder 52 is configured to abut with a rear end 54 of the sleeve 32 when the contact is assembled as illustrated in FIG. 5. That is, the collar 50 and shoulder 52 provide sufficient rearward travel of the sleeve 32 on the contact body 22 to provide proper alignment and engagement with spring 30 for securing the spring as discussed herein. A tip end 56 of the sleeve is then positioned proximate to a tip end 58 of the spring 30.

Referring again to FIG. 4, the pin section 38 is positioned forwardly of solid section 36 and is also solid for a portion or distance rearwardly of the bore 40. The pin section is also formed to have an outer diameter slightly smaller than the outer diameter of the solid section 36. The pin section also forms bore 40, which is generally shorter than bore 26 and is configured for receiving the tip of a pin that is inserted into sleeve 32 and spring 30 when the contact is assembled as illustrated in FIG. 5. To that end, the bore 40 has a tapered end 60 that can guide the tip of a pin as it is inserted through the spring 30 and to seat inside the bore 40. Generally, bore 40 will be formed to have an inner diameter similar to the outer diameter of a male pin for the purposes of a snug friction fit.

In accordance with one aspect of the present invention, contact 20 incorporates features formed in the contact body 22 for securing spring 30 with body 22. The present invention provides for a robust construction with minimized manufacturing steps for forming the multiple piece contact 20. Specifically, referring to FIGS. 2-4, contact body 22, and particularly pin section 38 is stamped with the cold head equipment to form a plurality of discrete indentations 64 that extend inwardly toward the center axis 26 of body 22 at discrete positions around body 22. The discrete indentations 64 are stamped into body 22, essentially at the interface between solid section 36 and the pin section 38. The indentations are formed to extend radially inwardly in the body and to have a sloped surface 65 that slopes radially inwardly in the body toward axis 27 as shown in FIG. 4 for engaging features of the spring as discussed herein. Because of the discrete nature of the indentations 64, they may be stamped with appropriate dies of cold head equipment, rather than having to be machined around the body 22. This provides a significant savings and eliminates time consuming steps with respect to manufacturing contact 20. For example, blades of the cold head equipment may be directed in from the sides of the contact body to form the features and then retracted. This reduces the cost from a body that is screw machined wherein the part is turned to create a feature all the way around the contact body. The result is that you can form a contact body at a rate of essentially two (2) parts per second versus a single part every 40-50 seconds using a screw machined contact body. Furthermore, the unique securement provided between body 22 and spring 30 in the present invention eliminates the need for significant features to be formed within the sleeve 32, further eliminating costly manufacturing steps in forming contact 20.

Figure 3A:
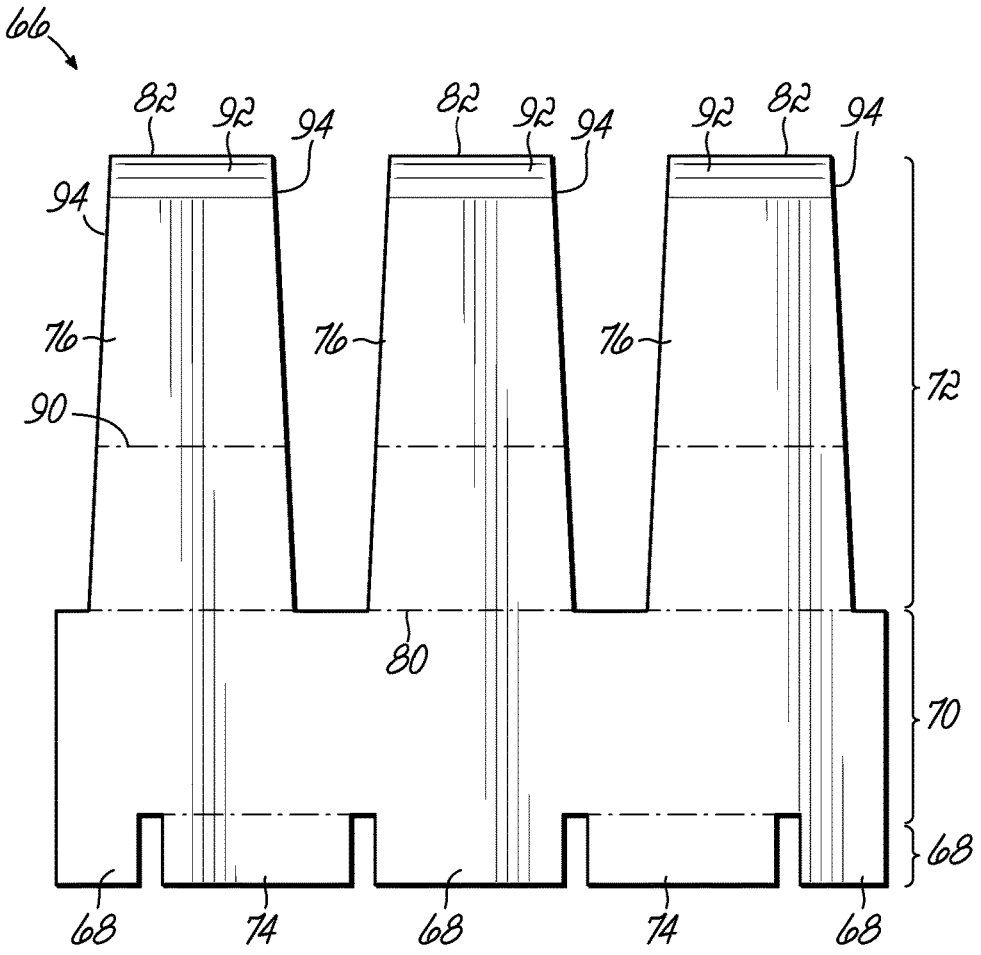
FIG. 3A is a plan view of a blank for forming a spring body in accordance for the contact of FIG. 1 in accordance with an embodiment of the invention.

Turning now to FIGS. 3 and 3A, the spring 30 is uniquely constructed for a robust electrical connection in combination with a secure construction within the contact 20. FIG. 3A illustrates spring 30 that is formed initially as a flat stamped blank 66. The spring blank 66 is then rolled or formed into spring 30. The spring blank 66 includes a tongue section 68, a base section 70, and a finger section 72. The tongue section 68 is constructed to provide a plurality of tongues 74 that are formed on the spring 30 for engaging indentations 64 when spring 30 is engaged with contact body 22. As illustrated further herein, base section 70 is configured to overlie pin section 38 when the contact is constructed as illustrated in FIG. 5. Finger section 72 forms a plurality of discrete fingers 74 that are part of the female portion of the contact 20 for gripping a male pin when contact 20 is engaged with another matching contact.

As noted, spring blank 66 may be stamped out of a flat piece of a suitable conductive metal material, such as copper. In accordance with one aspect of the invention, the spring blank 66 may be plated or coated with another conductive material, such as gold. Preferably, the gold may be plated thicker in the finger section 72 since the finger section 72 and the individual fingers 76, when formed into spring 30, will create a mating area for reception of a male contact pin. Similarly, the bore 40 may be plated with a thicker layer of gold than other portions of body 22. The spring fingers 76 and bore 40 provide a mating area for a male pin received by contact 20. As such, it is desirable to have a greater amount of gold in those areas. The flat spring blank 66 and bore 40 may be separately plated with gold and then appropriately assembled as illustrated in FIGS. 3-5 providing the contact of the invention.

In accordance with another aspect of the invention, the individual fingers 76 are uniquely formed for providing a more robust construction as well as an improved electrical connection with a mating contact. Specifically, the fingers 76 are asymmetrically formed to provide a wider base 80 and a more narrow tip 82 as illustrated in FIG. 3A. More specifically, the fingers 76 are constructed in the blank 66 to have a somewhat triangular form with a wider base 80 where the fingers 76 engage the base section 70. Such a construction provides a stronger and more robust engagement with the base section 70 to resist deflection forces provided on the spring fingers 76 when engaged with a pin of the male contact portion of the connector. As understood by a person of ordinary skill in the art, such deflection and deformation of the spring finger 76 can result in intermittent electrical connections and ultimately failed connections and signal loss.

Referring to FIGS. 3A and 4, the spring blank 66 is formed over a suitable die for being rolled into a generally cylindrical shape for also forming a coaxial bore 81 in the spring that coaxially aligns with bores 40 and 26 along axis 27 when forming the contact. When spring 30 is formed, the fingers 76 are also indented or bent at their base 80 and along one or more additional bend lines 90 toward the coaxial axis 27 for contacting a male pin and flexing against the pin for a proper electrical connection. Generally, the spring is formed and the fingers 76 are bent to achieve form an inner bore and achieve an appropriate inner diameter to the bore 81. The inner diameter will depend on the outer diameter and dimensions of the male pin (not shown) and the bore 81 will be dimensioned to allow a certain amount of flexing of the spring fingers 76 to achieve a desired normal grip force on the male pin as is known in the art. Referring again to FIG. 4, when the blank is rolled around a die and the spring fingers 76 are appropriately bent toward each other as noted to bring the tip ends 82 closer together and form the cylindrical bore 81, the bore will generally have a smaller inner diameter at the fingers than the inner diameter at the base section 70 of spring 30 for a robust electrical connection. Generally, the base section 70 might have an inner diameter close to the outer diameter of pin section 38 for a good electrical contact between the spring and body 22.

Specifically, referring to FIG. 4, the spring 30 may be formed by wrapping the blank 66 around an appropriate die to form a cylindrical spring. The die is configured so that the spring fingers are also bent inwardly toward the center axis 27 generally proximate to the lines 80, 90 as illustrated in FIG. 4. As shown in FIG. 1, the flexed fingers 76 are formed in spring 30 so that the tip ends 82 of the springs are brought together to form the cylindrical opening and the bore 81 of the spring.

To guide a male contact pin into bore 81, the tip ends 82 of the spring fingers 76 are also formed to be tapered with an appropriate taper 92 as illustrated in FIGS. 3 and 4 so that the pin proceeds smoothly into the contact. As part of the stamping process, the tip ends 82 of the various springs are tapered appropriately, such as at an angle of 30-60 degrees, to form a lead-in taper 92 for receiving a pin and guiding the pin into bore 80 and into engagement with fingers 76. Thus, the pin may be guided into spring 30 and bore 40 and into proper engagement with the contact 20 without the need for flaring the tip ends of the spring.

Figure 2:
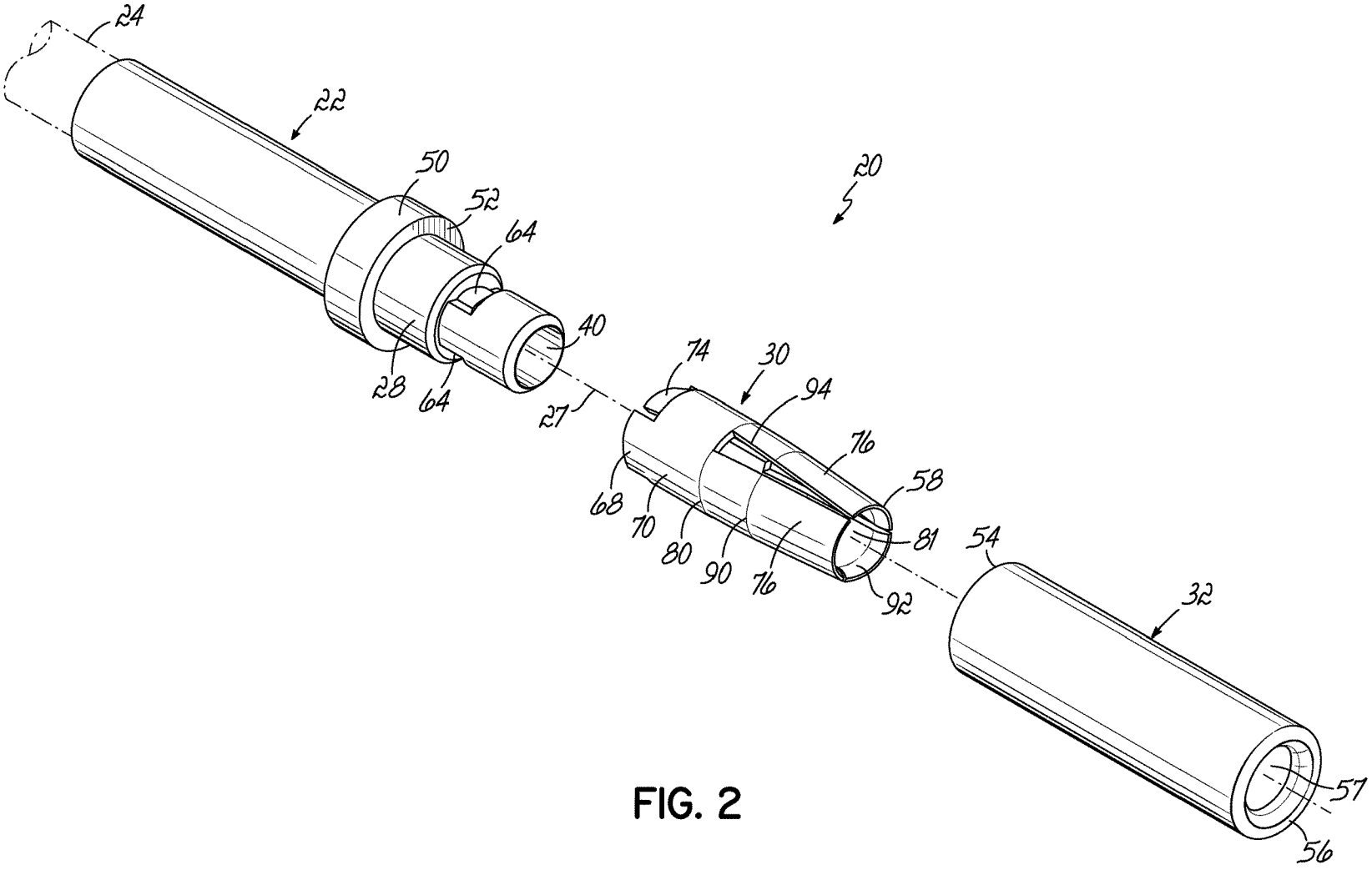
FIG. 2 is an exploded perspective view of the contact of FIG. 1 in accordance with an embodiment of the invention.

The spring includes a plurality of slits 94, as illustrated in FIGS. 1, 2 and 3A, that lie between each of the spring fingers. Because of the unique shape of the spring fingers having a wider base end 80 than the tip end 82, the width of the slit 94 between the individual fingers is reduced. Furthermore, each of the spring fingers has an improved ability to spring back into place upon deflection and thus provide a more robust electrical connection. The unique construction of the spring and fingers 76 eliminates the need to have additional features formed into the sleeve 32 for preventing overflexing or over extension of the spring fingers.

In accordance with one specific feature of the invention, the spring 30 is secured with body 22 utilizing a plurality of discrete tongues 74 that are formed integrally in the spring 30. The discrete tongues 74 are formed on a die to extend radially inwardly toward axis 27 of the contact and are positioned around the spring and configured to engage a respective plurality of discrete indentations 64 formed in the solid body 22. The tongues 74 might be bent and formed in the blank when the spring is formed over a suitable die. The tongues 74 are discrete structures that extend radially inwardly to engage the various discrete indentations 64 at positions around outer circumference of the contact body 22. As noted, because of the discrete indentations, the indentations may be formed in a stamping process without having to machine around the entire contact body 22. Similarly, the discrete tongues may be formed and bent appropriately for engagement into the depths of each of the indentations 64 to secure spring 30 with the body 22 without requiring additional structures for securing the spring 30 with the contact body. The tongues 74 are formed to angle inwardly at an angle $\theta_1$ in the range of 20-40 degrees. In one embodiment, the angle $\theta_1$ might be approximately 30 degrees with respect to the coaxial axis 27 and the base section 70 of the spring to align generally with the slope of surface 65. The stamped indentations 64 have a depth of approximately 0.005 inches and the tongues 74 are configured in one embodiment to extend to the bottom of the indentations 64. In that way, the spring is securely held to the body 22 of the contact to surround pin section 38 as illustrated in FIG. 4.

The sleeve 32 is of a solid construction and may be formed with a deep draw process. The sleeve may be formed of an appropriate metal, such as stainless steel. Sleeve 32 forms an internal bore 57 which coaxially aligns with the internal bore 80 of the spring, and bore 40 of body 22. In that way, a male pin may slide into the contact and through sleeve 32 to engage the fingers 76 of the spring 30 and bore 40 of the contact body for a secure electrical engagement. Referring to FIGS. 4 and 5, the tip end 56 of sleeve 32 is appropriately rolled inwardly and backwardly with respect to the sleeve 32 to guide a male pin into the contact and into the tapered ends 92 of the spring 30 for proper engagement. The inner diameter of bore 57 is the same as or slightly smaller than the outer diameter of the base section 70 of spring 30, when the spring is formed around the die and positioned over the pin section 38 of the solid body. The outer diameter of the slightly smaller pin section 38 when combined with the thickness of the spring at base section 70 may be equal to the outer diameter of the solid section 36 of the contact body 22 for a snug press fit of the sleeve onto the spring and contact body as shown in FIG. 5.

Turning now to FIGS. 4 and 5, to complete construction of contact 20, the spring 30 is slid over the solid contact body until the rear end or tongue section 68 of the spring engages the solid section 36 of the contact body 22. The tongues 74 are slid or snapped into respective indentations 64 to secure the spring to the body. Then sleeve 32 is slid over the spring 30 and a portion of the solid section 36 of body 22 of the contact to engage the spring and hold the discrete tongues 74 into engagement with the discrete indentations 64. The inner diameter of the sleeve 32 is configured and dimensioned to provide for a snug press fit as illustrated in FIG. 5 with the surface 28 of the body 22. The press fit is provided against the surface 28 of the solid section 36 of the body 22 for securing sleeve 32 in place. The sleeve also has a snug press fit against a base section 70 of the spring to make a good electrical contact between the body at pin section 38 and base section 70 of the spring. The collar 50, forms shoulder 52, against which the rear end 54 of the sleeve abuts as shown in FIG. 5.

Because of the unique construction of the contact of the invention incorporating a plurality of inwardly radially extending tongues 74 and discrete stamped indentations 64 without machining, a significant cost and time savings in realized with the invention. The spring may be secured with just the cylindrical sleeve 32 without additional features being formed either within the spring 30 or the sleeve 32. As such, the construction of sleeve 32 eliminates various stamping, machining and other processing steps associated with sleeve 32, thus further reducing the overall cost of manufacturing the contact 20.

Similarly, because of the unique formation of spring 30 that incorporates spring fingers 76 having wider dimensions at the base end 80 than at the tip end 82, the present contact eliminates the need for any particular features to be formed into sleeve 32 that would limit the travel of the spring fingers 76 to prevent over extension. Prior art contacts often require additional structures to prevent over extension or overflexing of the spring fingers 76.

Accordingly, the contact of the present invention as illustrated in FIGS. 1-5 provides a unique contact that may be cost-effectively produced with minimal formation steps but still achieves a robust construction and a solid electrical connection with a male pin of a mating contact.

Figure 6:
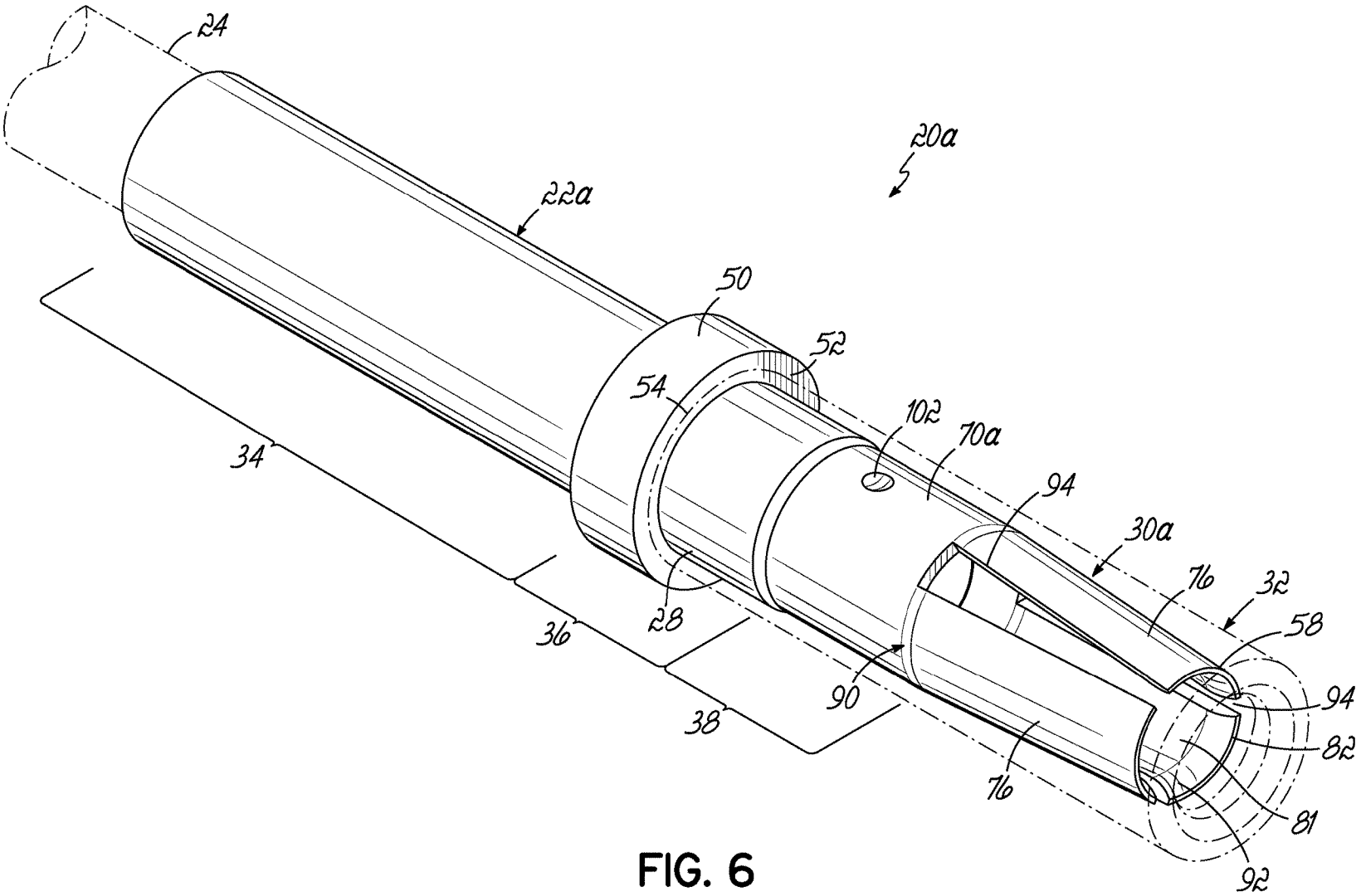
FIG. 6 is perspective view of a contact in accordance with another embodiment of the invention.
Figure 7:
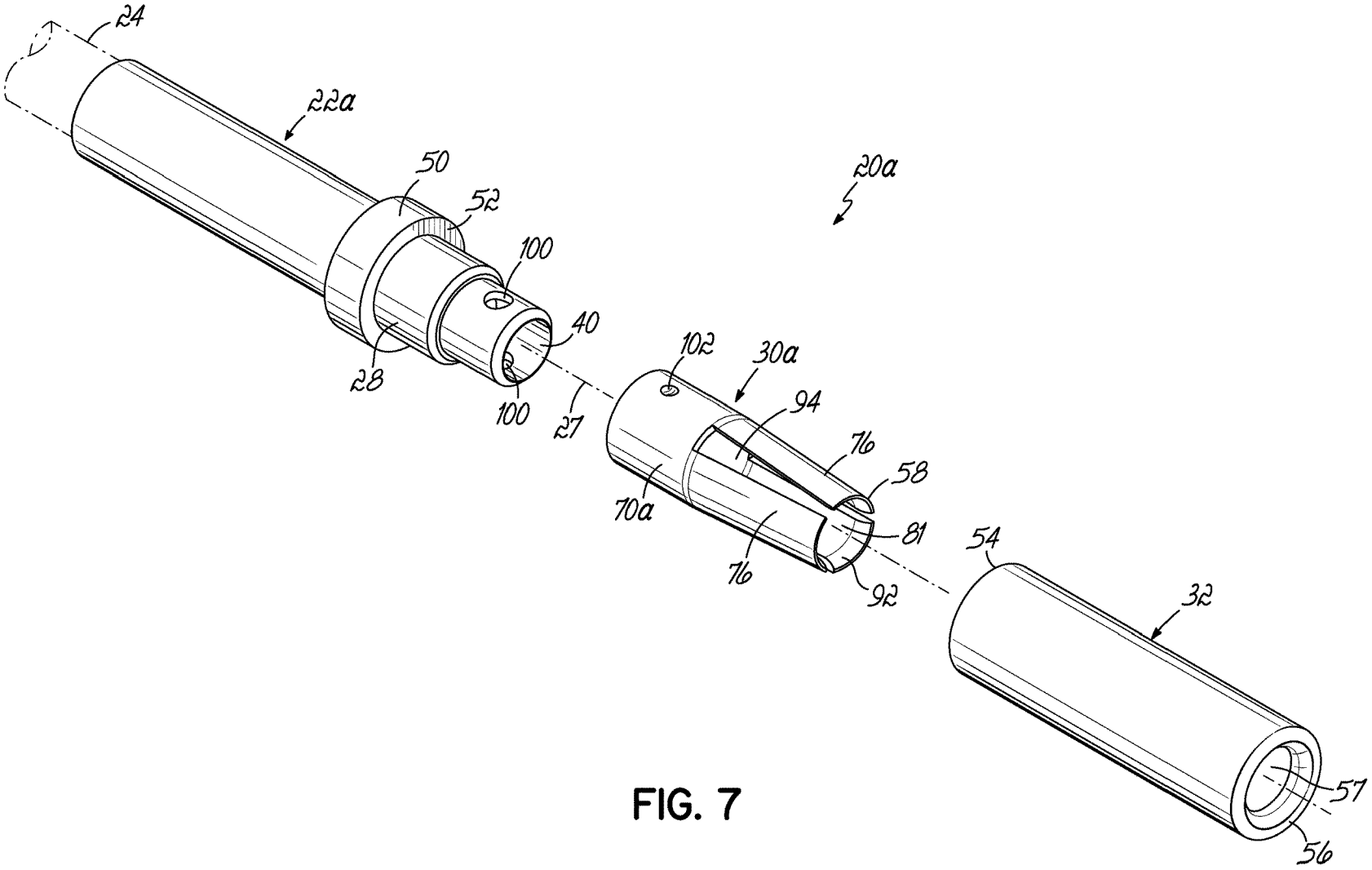
FIG. 7 is an exploded perspective view of the contact of FIG. 6 in accordance with one embodiment of the invention.

FIGS. 6-9 illustrate an alternative embodiment of the contact of the present invention utilizing different inwardly radially extending structures for securing the spring with the contact body. Specifically, referring to FIGS. 6-9, structures are shown wherein discrete and radially inwardly extending structures in the spring engage discretely-formed features within the contact body. The embodiment of the contact **20*a* as illustrated in FIGS. 6-7 is similar in many aspects to the embodiment of contact 20 illustrated in FIGS. 1-5** and thus like numerals are used for various of the parts and features forming contact.

Figure 8:
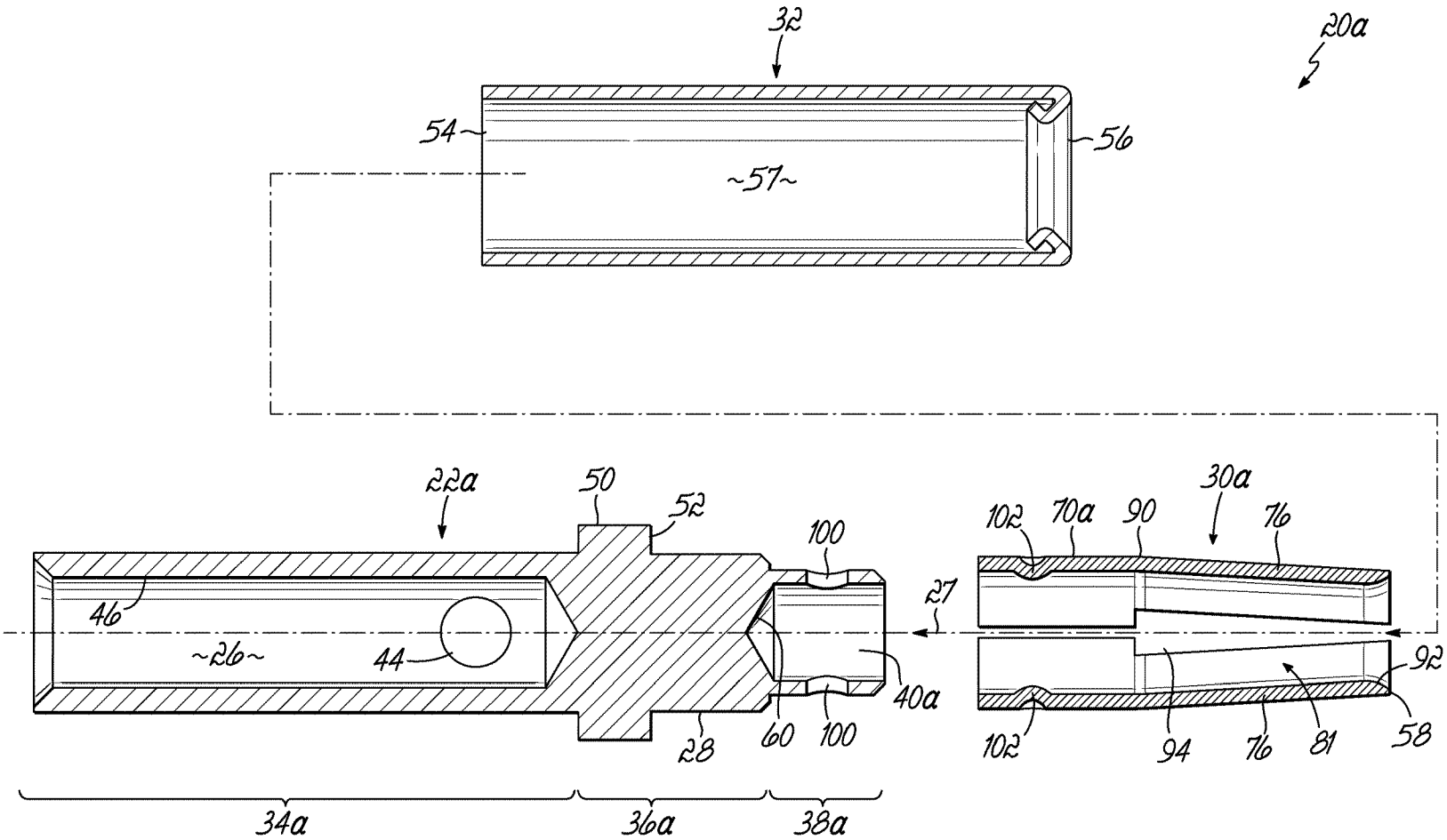
FIG. 8 is an exploded side view, in partial cross-section, of the contact of FIG. 6 in accordance with one embodiment of the invention.

In accordance with the embodiment of contact **20*a*, a plurality of discrete apertures 100 are formed in the pin section 38*a* of the solid housing body 22*a*. In one embodiment, rather than being formed rearwardly of the bore within the pin section, the apertures 100 are formed in pin section 38*a* to extend radially inwardly toward axis 27 and into the bore 40*a* (see FIG. 8). The discrete apertures 100 are positioned in discrete positions around body 22*a* and in the illustrated embodiment two apertures are positioned generally 180 degrees from each other. A greater or lesser number of apertures 100 may be utilized in accordance with the invention and thus the invention is not limited to using two apertures as illustrated in FIGS. 6-8**.

The spring elements that engage body **22*a* and the apertures 100 include a plurality of inwardly extending and discrete radial elements, such as dimples 102 at positions along the spring blank. The dimples 102 may be formed by a stamping process in the spring blank. The spring 30*a* is then formed around a suitable die as discussed herein and the dimples are oriented to extend radially inwardly at discrete positions around the body 22*a*. The discrete dimples 102 extend radially inwardly toward axis 27 and may be formed during the spring stamping process without an additional machining step required. The dimples 102, are configured and arranged to engage appropriate aligned and discrete apertures 100 in the contact body 22*a*. That is, when a base section 70*a* of the spring 30*a* extends over pin section 38*a* of body 22*a*, the discrete dimples 102 engage appropriate apertures 100 to secure the spring 30*a* into position. Then, sleeve 32 is positioned over spring 30*a* and body 22*a* and specifically over the pin section 38***a* and a portion of the solid section 36*a* of body 22*a* to secure the dimples 102 in the apertures 100 and thus form the contact and prevent the spring 30*a* from sliding longitudinally along axis 27 within the contact 20*a*.

Figure 9:
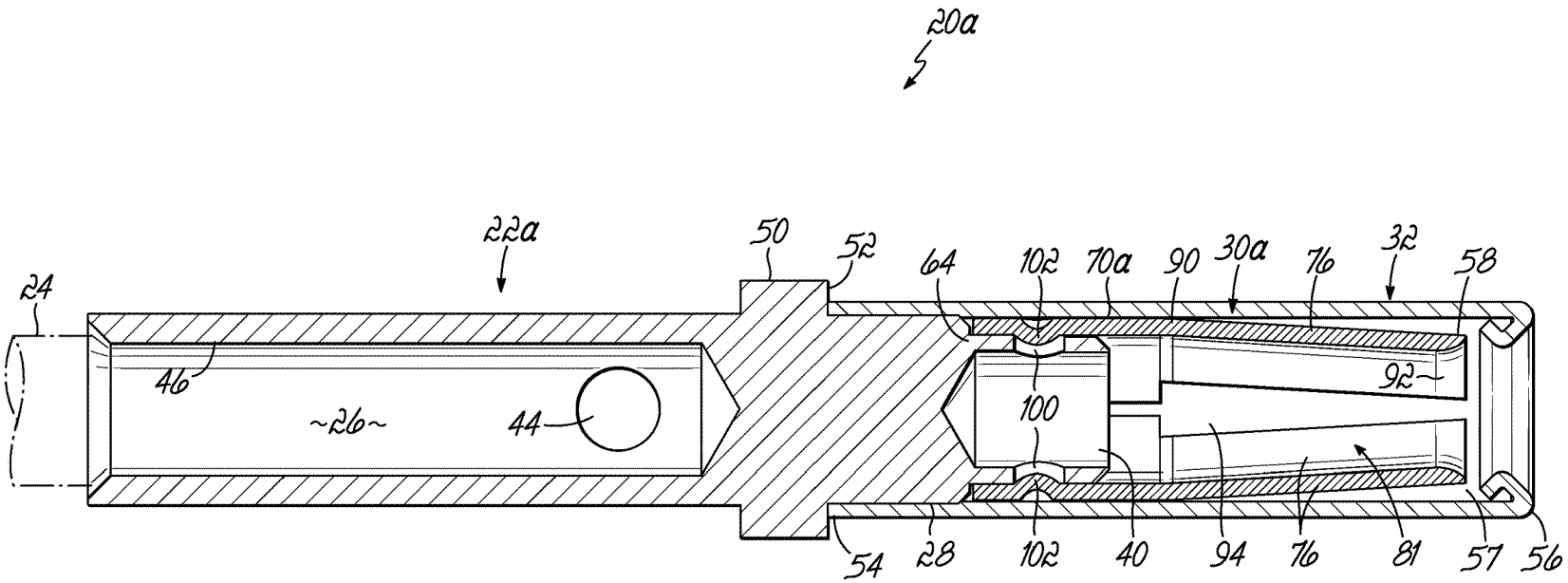
FIG. 9 is a side cross-sectional view of the contact of FIG. 6 in accordance with one embodiment of the invention.

The sleeve 32, similar to the embodiment of FIGS. 1-5, is press fit onto the body 22*a* and specifically onto surface 28 of the solid section 36. The inner diameter of the sleeve 32 is configured and dimensioned to provide for a snug press fit as illustrated in FIG. 9 with the surface 28 of the body 22. The press fit is provided against the surface 28 of the solid section 36 of the body 22 for securing sleeve 32 in place. The sleeve also has a snug press fit against a base section 70*a* of the spring to make a good electrical contact between the body at pin section 38 and base section 70*a* of the spring. As noted, the travel of sleeve 32 would be stopped by collar 52 and shoulder 54. The contact as illustrated in FIGS. 6-9 shares many of the other various inventive features and advantages as discussed herein with respect to contact 20 in FIGS. 1-5.

Figure 7A:
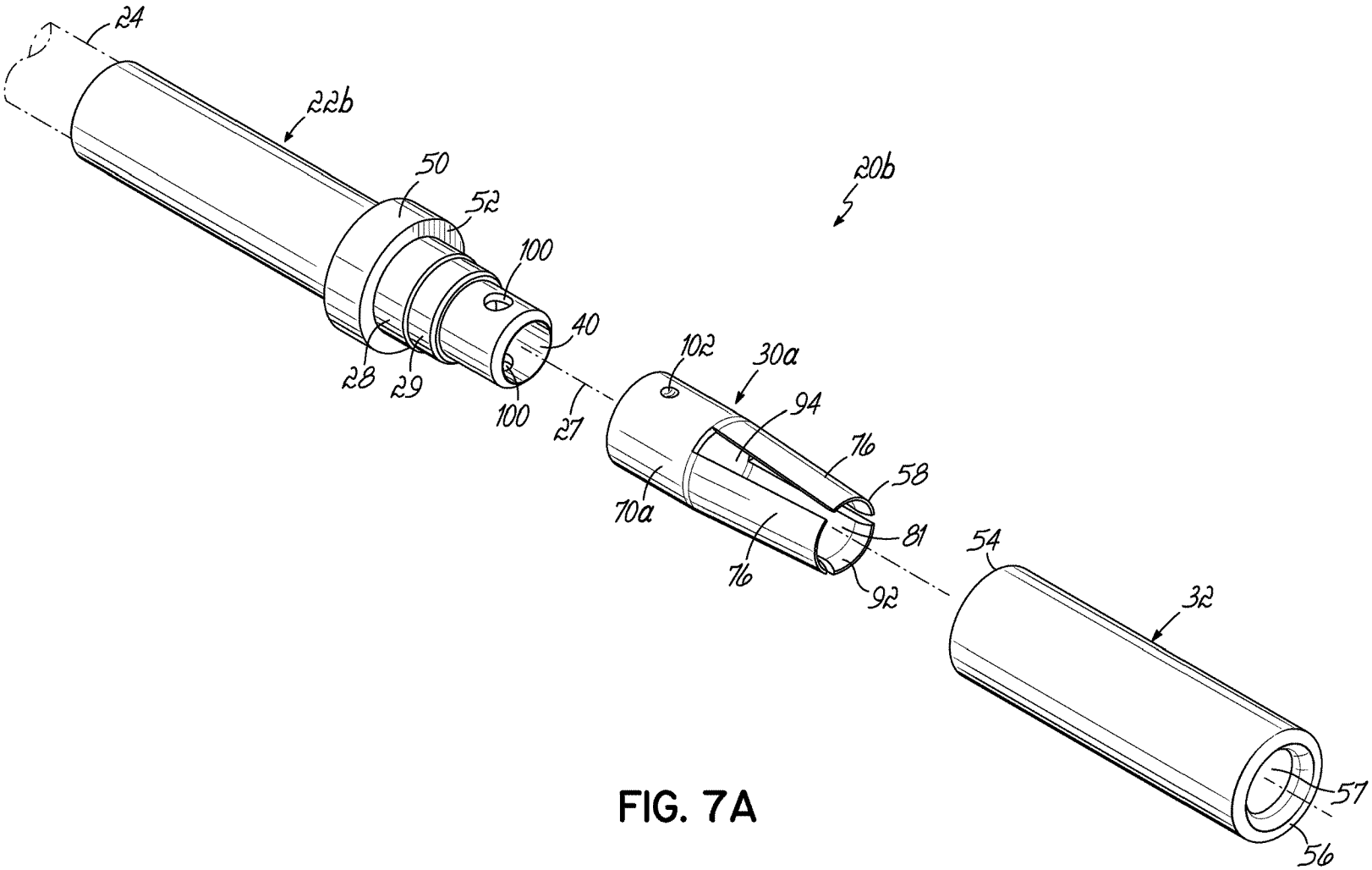
FIG. 7A is an exploded perspective view of a contact similar to the contact of FIG. 7 in accordance with another embodiment of the invention.

FIG. 7A illustrates an embodiment 20*b* similar to that of FIG. 7 but with some variation in the solid section 36 of the body 22*b*. The solid section of body 22*b* is configured in the form of a series of step sections 28, 29, similar to the embodiment of FIGS. 10-14 discussed herein. To that end, step section 29 or a second step section has a smaller outer diameter than the outer diameter of step section 28 or first step section for providing suitable clearance during the press fit as discussed herein. In that way, the press fit process is enhanced. Sleeve 32, similar to the embodiment of FIGS. 1-5, is press fit onto the body 22*b* and specifically onto surface 28 of the solid section 36. The inner diameter of the sleeve 32 is configured and dimensioned to provide for a snug press fit with the surface 28 of the body 22 for securing sleeve 32 in place.

Figure 10:
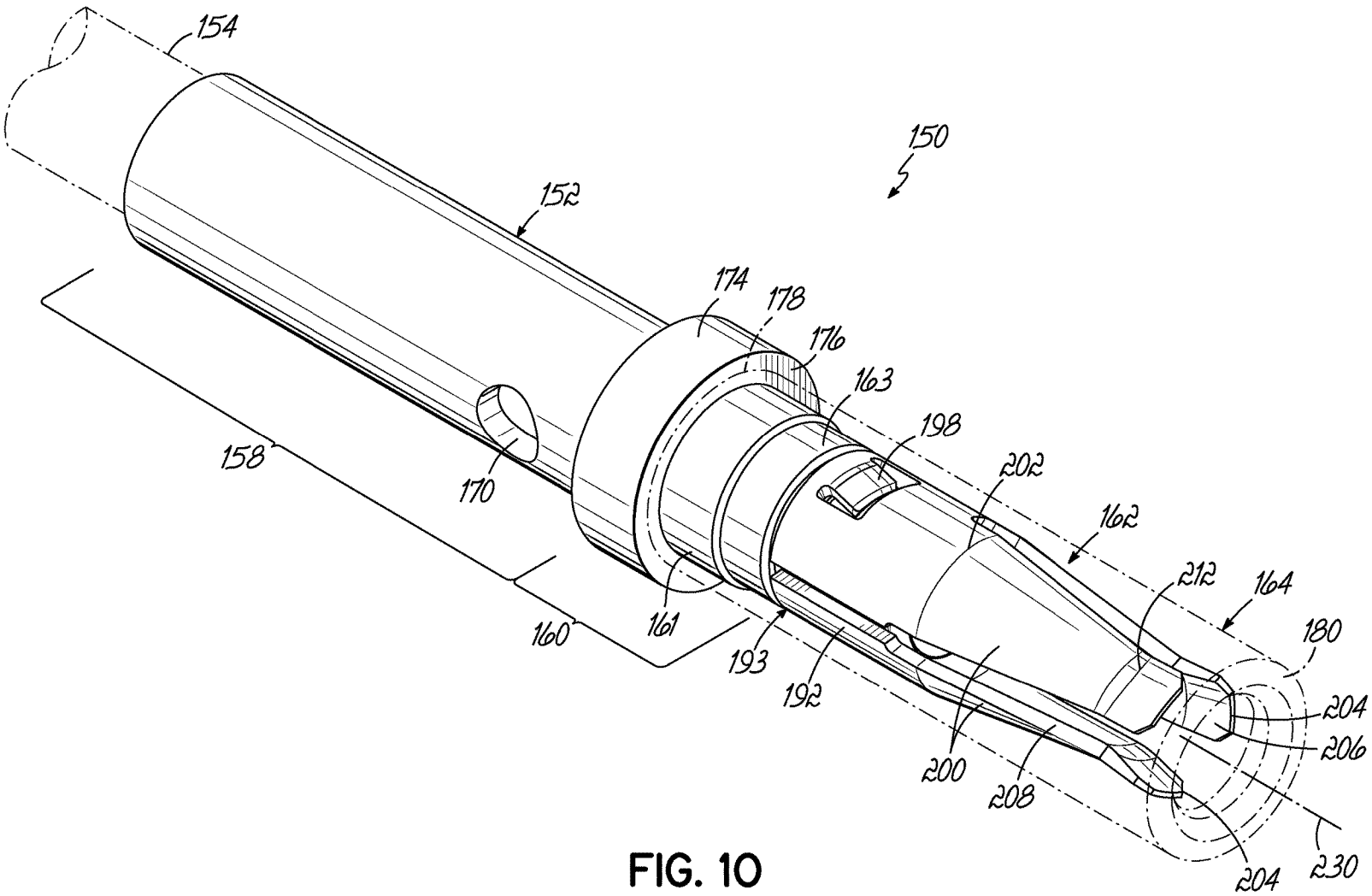
FIG. 10 is perspective view of a contact in accordance with another embodiment of the invention.
Figure 11:
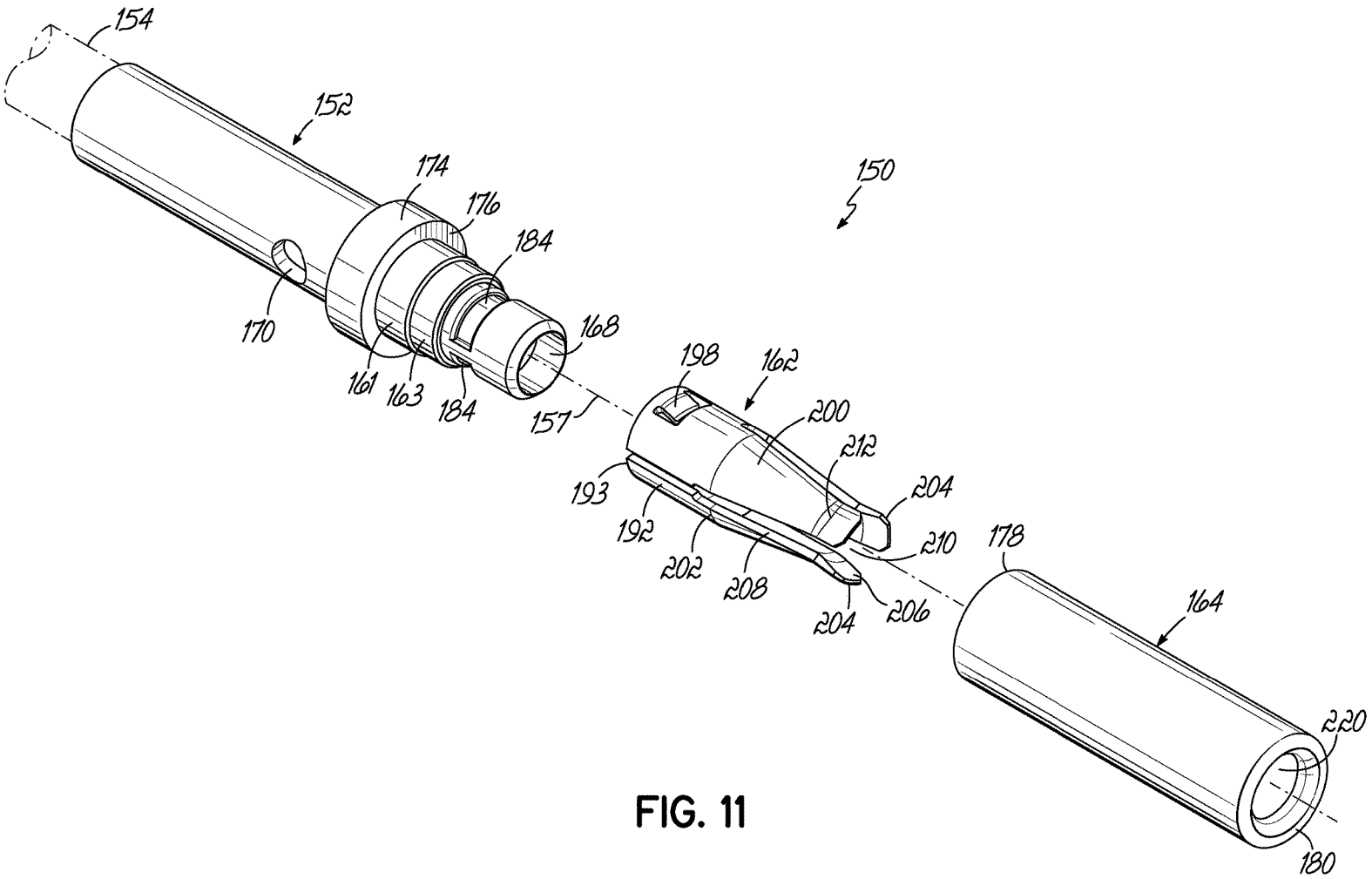
FIG. 11 is an exploded perspective view of the contact of FIG. 10 in accordance with another embodiment of the invention.
Figure 12:
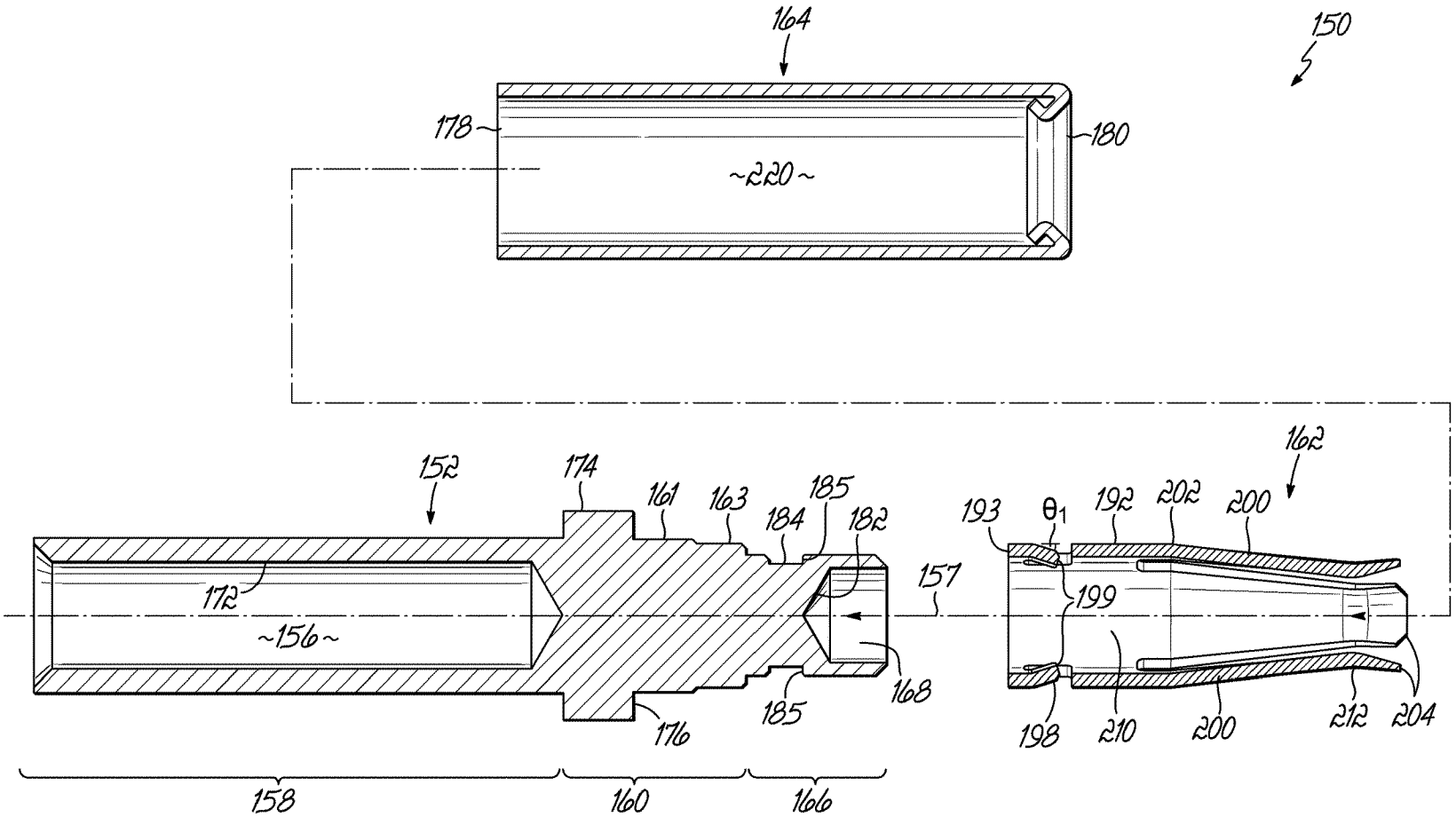
FIG. 12 is an exploded side view, in partial cross-section, of the contact of FIG. 10 in accordance with another embodiment of the invention.

FIGS. 10-14 illustrate another embodiment of a multiple piece electrical connector contact of the invention. Similar to other embodiments, contact 150 forms a female portion of an overall larger electrical connector assembly and couples with a suitable cable or conductor, and a male contact or portion of the connector assembly, including a pin (not shown), engages with the female contact 150 as illustrated in FIG. 10 for the electrical connection. The contact 150 includes multiple pieces or sections that are assembled together to form the complete contact. Specifically, a solid contact body 152 engages with a suitable wire or cable 154. Generally the exposed conductor of the cable 154 is inserted into body 152. Body 152, as illustrated in FIG. 12, has a bore section 158 which forms an internal bore 156 that is configured for receiving the inner conductor (not shown) of cable 154. Body 152 and bore 156 may be configured and sized to couple with various different sizes of cables and conductors as appropriate and the invention is not limited to the size of the cable nor the size of the contact. An inner conductor of cable 154 may be appropriately secured in the bore 156 by known methods, such as by crimping or soldering, etc.

Figure 13:
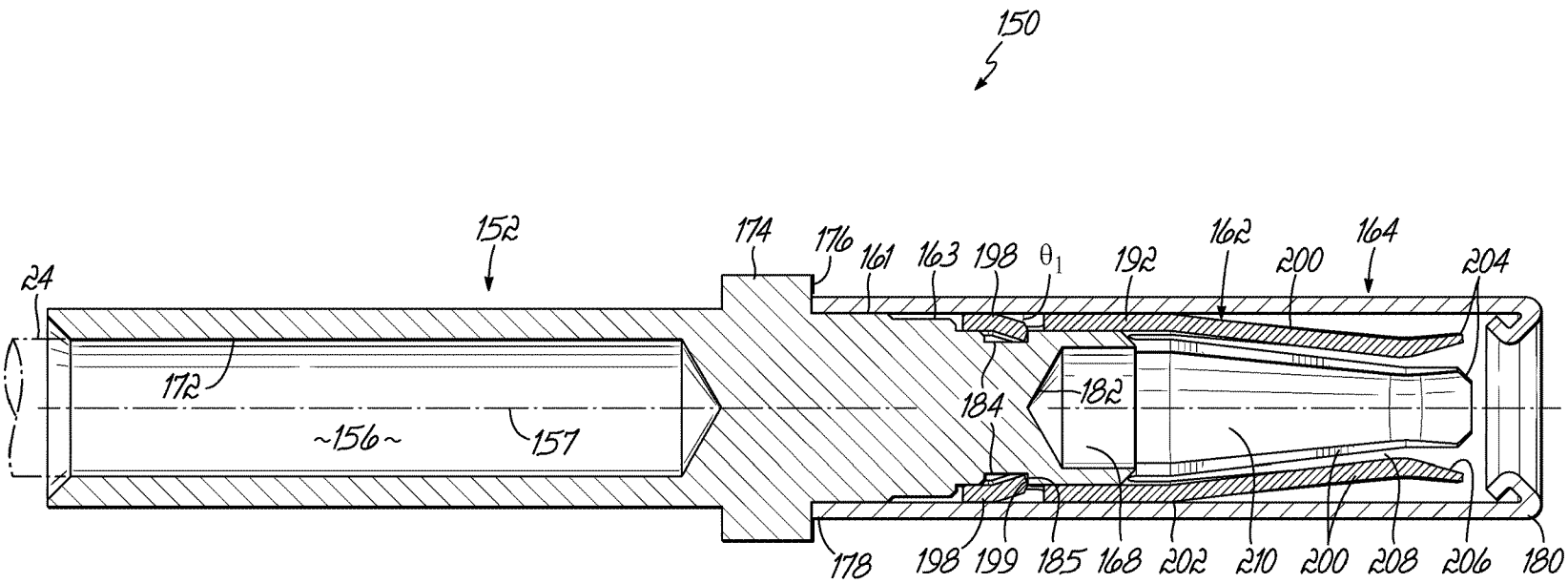
FIG. 13 is a side cross-sectional view of the contact of FIG. 10 in accordance with another embodiment of the invention.

Forwardly of the bore 156 and bore section 158, body 152 includes a solid section 160 having features and a construction as discussed herein for engaging a separate spring piece or spring 162 and a sleeve piece or sleeve 164 for forming the multiple piece contact as described herein. As illustrated in FIGS. 11, 12, to form the multiple piece contact 150, body 152, spring 162, and sleeve 164 are all axially aligned to form the contact. First, the spring 162 is secured to body 152 and then sleeve 164 overlies the spring 162 and a portion of body 152. FIG. 13 illustrates a cross-sectional view of the assembled multiple piece contact 150 in accordance with one embodiment of the invention.

Referring again to FIGS. 11 and 12, body 152 includes the bore section or conductor section 158 that defines bore 156. Forward of the conductor section 158 is the solid section 160 configured for engaging and securing the other pieces of the multiple piece contact as described herein. Forward of the solid section 160 is a pin section 166 that also defines an internal bore 168 for receiving the tip of a male mating pin or male contact (not shown) that will be engaged with contact 150 in a conventional fashion to form a completed connector.

Body 152 may be formed of a suitable conductive metal, such as brass, a copper alloy, or aluminum, for example. Other suitable metals might also be utilized. As illustrated in FIG. 12, the conductor section 158 might include one or more apertures 170 formed therein and allowing access into bore 156, such as for the flow of a conductive coating or plating material in the bore. For example, the internal surface 172 of bore 156 may be gold plated for improved electrical conduction. As noted, a conductor inserted into bore 156 might be appropriately secured, such as by being crimped or being soldered therein.

In accordance with one embodiment of the invention, the body is stamped with cold head equipment rather than being machined. The solid section 160 of the body 152 may be formed to have an outer diameter essentially equal to the outer diameter of the conductor section 158 although not required. A collar 174 is also formed in the solid section 160. The collar may be cold formed into a portion of the solid section 160 and essentially is formed to have a larger outer diameter than the rest of the solid section. The collar 174 is positioned on solid section 160 more toward the conductor section 158 and rearwardly of pin section 166. Collar 174 has a larger diameter and essentially forms a shoulder 176 on the solid section that is positioned rearwardly of pin section 166. The shoulder 176 is configured to abut with a rear end 178 of the sleeve 164 when the contact is assembled as illustrated in FIG. 13. That is, the collar 174 and shoulder 176 provide sufficient rearward travel of the sleeve 164 on the contact body 152 to provide proper alignment and protection of the spring 162 for securing the spring as discussed herein. A tip end 180 of the sleeve is then positioned proximate to a tip end 186 of the spring 162. (See FIG. 13)

To secure the sleeve 164, the solid section 160 includes a series of step sections of different outer diameters. In the disclosed embodiment two step sections are shown but a greater number could also be used without deviating from the invention. The step sections include step section 161 or a first step section and step section 163 or a second step section. In the illustrated embodiment, they are located rearwardly of the pin section and are smaller in diameter than the collar 174. The first step section 161 is configured to receive rear end 178 of sleeve 164 to secure the sleeve with the body with a press fit of the sleeve on the body. The second step section 163 of a smaller outer diameter provides clearance of the sleeve for an easier press fit with respect to the spring 162 when the assembly is put together as illustrated in FIG. 13. In that way, the sleeve does not engage along the entire solid section 160 in a press fit while sufficiently engaging the body and the spring when the sleeve overlies the spring in the completed contact. Again, step section 163 has a smaller outer diameter than the outer diameter of step section 161 for providing suitable clearance. Because of the unique construction and operation of the spring in accordance with features disclosed herein, in the embodiment of the contact 150 illustrated, the sleeve 164 engages with spring 162 for pushing on the spring and in turn pushing on the tongues and securing the tongues 198 with indentations 184 to provide for a good electrical connection between the body 152 and the spring 162. (FIG. 13) The sleeve may also engage the spring 162 proximate the base section 192 of the spring for further electrical coupling of the body and spring.

Referring again to FIG. 12, the pin section 166 is positioned forwardly of solid section 160 and is also solid for a portion or distance rearwardly of the bore 168. The pin section is also formed to have an outer diameter slightly smaller than the outer diameter of the step sections 161, 163 of the solid section 160. As discussed below, the spring slides onto pin section 166 so that tongues 198 in the spring 162 engage indentations 184 formed in the pin section 166. The pin section also forms bore 168, which is generally shorter than bore 156 and is configured similar to bore 40 as discussed herein. Bore 168 receives the tip of a pin that is inserted into sleeve 164 and spring 162 when the contact is assembled as illustrated in FIG. 13. To that end, the bore 168 has a tapered end 182 that can guide the tip of a pin as it is inserted through the spring 162 and to seat inside the bore 168. Generally, bore 168 will be formed to have an inner diameter similar to the outer diameter of a male pin for the purposes of a snug friction fit.

In accordance with one aspect of the present invention, the contact 150 incorporates features that are formed in the contact body 152 for securing spring 162 with body 152. The present invention provides for a robust construction and a good electrical connection with minimized manufacturing steps for forming the multiple piece contact 150. Specifically, referring to FIGS. 11-12, contact body 152, and particularly pin section 166 is stamped with the cold head equipment to form a plurality of discrete indentations 184 that extend radially inwardly in the body toward the center axis 157 of body 152 at discrete positions around body 152. The discrete indentations 184 are stamped into body 152, proximate the interface between solid section 160 and the pin section 166. The indentations are formed to extend radially inwardly in the body toward axis 157 as shown in FIG. 12 and have a suitable depth for engagement by the tongue features of the spring as discussed herein. Because of the discrete nature of the indentations 184, they may be stamped with appropriate dies of cold head equipment, rather than having to be machined around the body 152. This provides a significant savings by eliminating time consuming steps with respect to manufacturing contact 150. For example, blades of the cold head equipment may be directed in from the sides of the contact body to form the features and then retracted. This reduces the cost from traditional contact that are screw machined wherein the part is turned to create a feature all the way around the contact body. Furthermore, the unique securement provided between body 152 and spring 162 in the present invention eliminates the need for significant features to be formed within the sleeve 164, further eliminating costly manufacturing steps in forming contact 150.

Figure 11A:
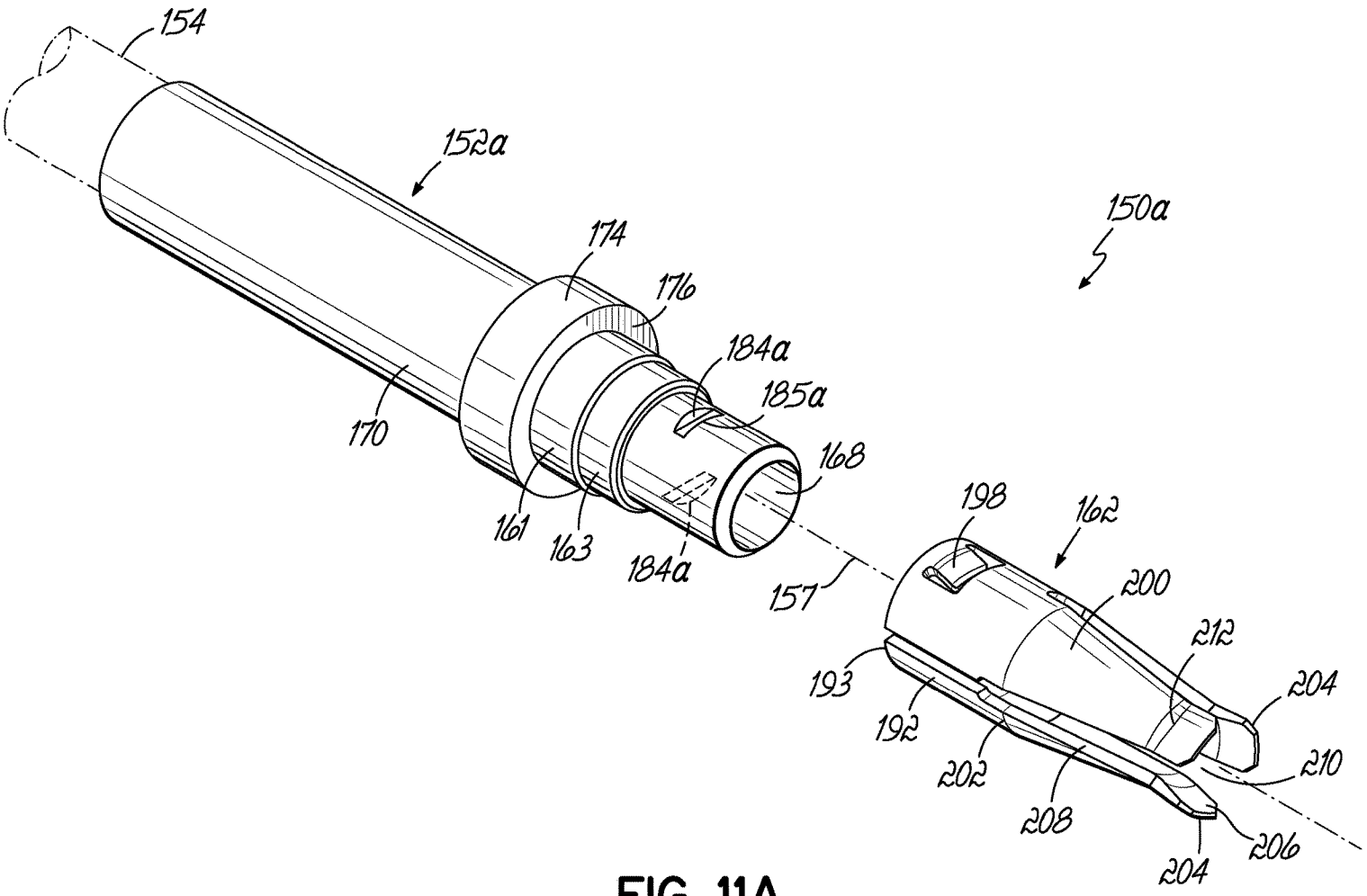
FIG. 11A is an exploded perspective view of a contact similar to the contact of FIG. 11 in accordance with another embodiment of the invention.

In the embodiment of FIG. 11 of contact 150, the indentations 184 are formed to extend for some distance circumferentially around the pin section to engage the tongues appropriately. In an alternative embodiment, as illustrated in the contact 150*a* of FIG. 11A, the indentations 184*a* are formed in the body 152*a* in a more linear design at discrete locations for engaging the tongues 198 appropriately.

Figure 14:
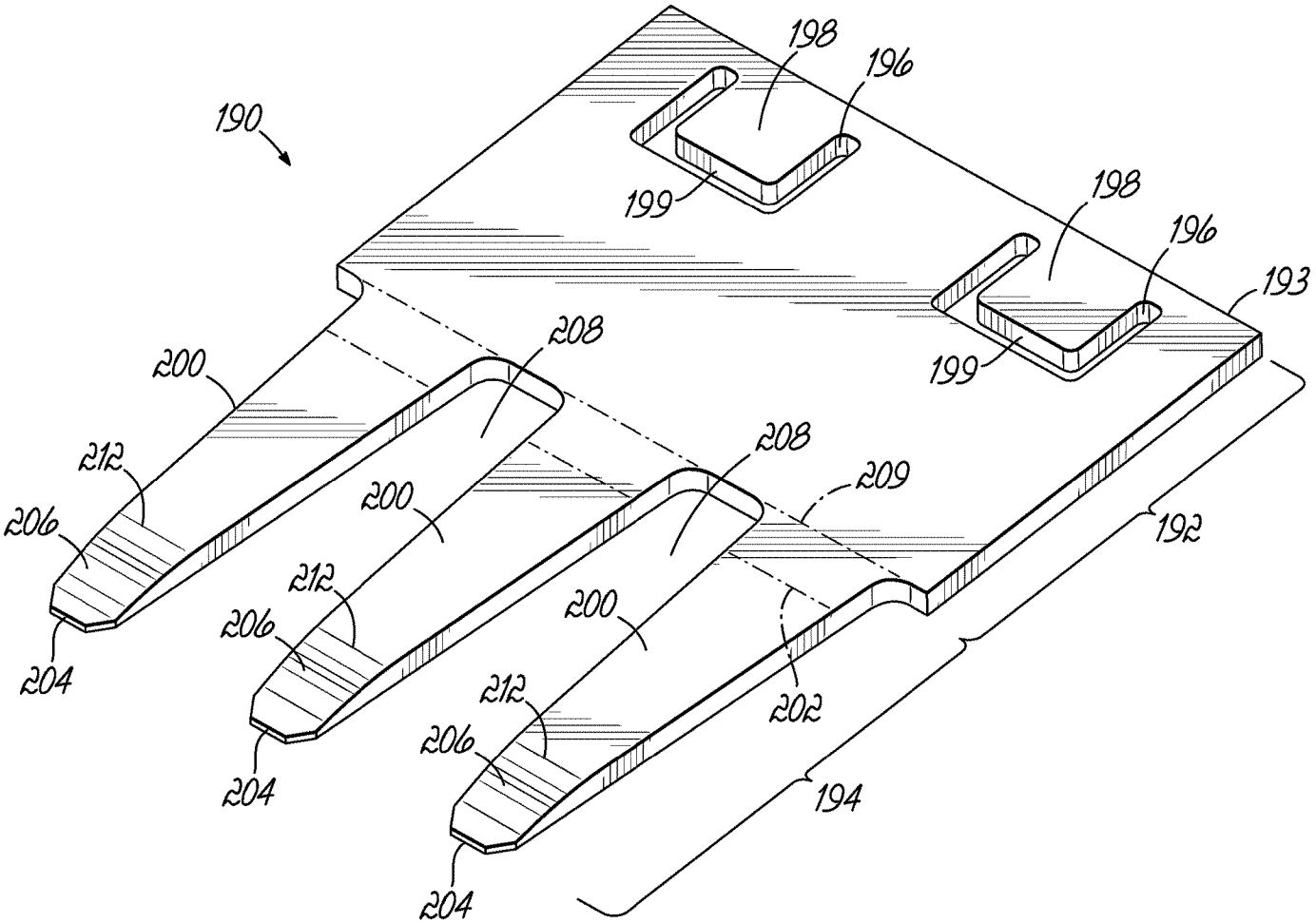
FIG. 14 is a plan view of a blank for forming a spring body in accordance for the contact of FIG. 10 in accordance with another embodiment of the invention.

Turning now to FIGS. 10 and 14, the spring 162 is uniquely constructed for a robust electrical connection in combination with a secure construction within the contact 150. FIG. 14 illustrates spring 162 that is formed initially as a flat stamped blank 190. The flat blank 190 is then rolled or formed into spring 162. The blank 190 includes a base section 192, and a finger section 194. A plurality of tongue cut out sections 196 are formed in the blank also. The tongue cut out sections 196 are constructed to provide one or more stamped tongues 198 that are formed and or bent on the spring 162 for engaging the indentations 184 when spring 162 is engaged with contact body 152. As discussed further below, the tongues are oriented to extend forwardly in the connector toward the fingers 200 and radially inwardly to engage the discrete indentations 184 for securing the spring 162. In one embodiment, as illustrated, a plurality of tongues is formed for extending radially inwardly around the inner diameter of the formed spring. For example, two tongues as shown might be positioned at 180 degree intervals around the spring. Of course a greater number of springs might be used as well and positioned around the spring circumference. As illustrated further herein, base section 192 is configured to overlie pin section 166 when the contact is constructed as illustrated in FIG. 13. More specifically, base section 192 and the end 193 of spring 162 overlie the pin section 166, such that tongues 198 engage indentations 184 and extend radially inwardly and into the indentations. Finger section 194 forms a plurality of discrete fingers 200 that are part of the female portion of the contact 150 for gripping a male pin when contact 150 is engaged with another matching contact.

As noted, spring blank 190 may be stamped out of a flat piece of a suitable conductive metal material, such as copper. In accordance with one aspect of the invention, the spring blank 190 may be plated or coated with another conductive material, such as gold. Preferably, the gold may be plated thicker in the finger section 194 since the finger section 194 and the individual fingers 200, when formed into spring 162, will create a mating area for reception of a male contact pin. Similarly, the bore 168 may be plated with a thicker layer of gold than other portions of body 152. The spring fingers 200 and bore 168 provide a mating area for a male pin received by contact 150. As such, it is desirable to have a greater amount of gold in those areas. The flat spring blank 190 and bore 168 may be separately plated with gold and then appropriately assembled as illustrated in FIGS. 11-13 providing the contact of the invention.

In accordance with another aspect of the invention, the individual fingers 200 are uniquely formed for providing a more robust construction as well as an improved electrical connection with a mating contact as discussed herein. Specifically, the fingers 200 are asymmetrically formed to provide a wider base 209 and a more narrow tip 204 as illustrated in FIG. 14. More specifically, the fingers 200 are constructed in the blank 190 to have a somewhat triangular form with a wider base 209 where the fingers 200 engage the base section 192 of blank 190. Such a construction provides a stronger and more robust engagement with the base section 192 to resist deflection forces provided on the spring fingers 200 when engaged with a pin of the male portion of the contact. As understood by a person of ordinary skill in the art, such deflection and deformation of the spring finger 200 can result in intermittent electrical connections and ultimately failed connections and signal loss.

Referring to FIGS. 11 and 13, the spring blank 190 is formed over a suitable die for being rolled into a generally cylindrical shape for also forming a coaxial bore 210 in the spring that coaxially aligns with bores 168 and 156 along axis 157 when forming the contact. When spring 162 is formed, the fingers 200 are also indented or bent at one or more bend lines 202, 209 inwardly toward the coaxial axis 157 for contacting a male pin and flexing against the pin for a proper electrical connection. Generally, the spring is formed and the fingers 200 are bent to form an inner bore and achieve an appropriate inner diameter to the bore 210. The inner diameter will depend on the outer diameter and dimensions of the male pin (not shown) and the bore 210 will be dimensioned to allow a certain amount of flexing of the spring fingers 200 to achieve a desired normal grip force on the male pin as is known in the art. Referring again to FIG. 12, when the blank is rolled around a die and the spring fingers 200 are appropriately bent toward each other as noted to bring the tip ends 204 closer together and form the cylindrical bore 210, the bore will generally have a smaller inner diameter at the fingers than the inner diameter at the base section 192 of spring 162 for a robust electrical connection.

To guide a male contact pin into bore 210, the tip ends 204 of the spring fingers 200 are also formed to be tapered with an appropriate taper 206, such as at an angle of 30-60 degrees as illustrated in FIGS. 10, 11 and 14 to form a lead-in taper for receiving a pin and guiding the pin into the bore. The taper may be formed as part of the stamping process, so the spring is configured for receiving a pin and guiding the pin into bore 210 and into engagement with fingers 200.

The spring includes a plurality of slits 208, as illustrated in FIGS. 10 and 14, that lie between each of the spring fingers. Because of the unique shape of the spring fingers having a wider base end 202 than the tip end 204, the width of the slit 208 between the individual fingers is reduced. Furthermore, each of the spring fingers has an improved ability to spring back into place upon deflection and thus provide a more robust electrical connection. The unique construction of the spring and fingers 200 eliminates the need to have additional features formed into the sleeve 164 for preventing overflexing or over extension of the spring fingers.

In accordance with one specific feature of the invention, the spring 162 is secured with body 152 utilizing a plurality of discrete forwardly-extending tongues 198 that are formed integrally in the spring 162. The discrete tongues 198 are formed with a die and are bent to extend forwardly toward the front end of the contact and also radially inwardly toward axis 157 of the contact. The tongues 198 are positioned around the spring and configured to engage the discrete indentations 184 formed in the solid body 152 and to also extend forwardly toward the fingers 200. As noted, the tongues 198 might be formed when the spring is formed over a suitable die. The tongues 198 are discrete structures that extend radially inwardly to engage the various discrete indentations 184 at positions around the outer circumference of the contact body 152 and extend forwardly to further secure the spring 162 with the solid body. In the embodiment, two tongues 198 are illustrated and are generally positioned on opposite sides of the spring. A greater or lesser number of tongues might also be utilized.

As noted, because of the discrete indentations 184, the indentations may be formed in a stamping process without having to machine around the entire contact body 152. Similarly, the discrete tongues may be formed and bent appropriately for engagement into the depths of each of the indentations 184 to secure spring 162 with the body 152 without requiring additional structures for securing the spring 162 with the contact body. The tongues 198 are formed to angle inwardly at an angle $\theta_1$ in the range of 20-40 degrees. In one embodiment, the angle $\theta_1$ might be approximately 30 degrees with respect to the coaxial axis 157 and the base section 192 of the spring. The stamped indentations 184 have a depth of approximately 0.005 inches and the tongues 198 are configured in one embodiment to extend generally to the bottom of the indentations 184. The forward edges 199 of the tongues 198 abut with forward edges 185 of indentation 184 (See FIG. 13) or forward edges 185*a* of the indentations 184*a* (See FIG. 11A). In that way, the spring 162 is securely held to the body 152 of the contact to surround pin section 166 as illustrated in FIG. 13. Furthermore, any forces axially on the spring in the direction of pulling the spring from the body are resisted by the forwardly facing tongues in the indentations.

The sleeve 164 is of a solid construction and may be formed with a deep draw process. The sleeve may be formed of an appropriate metal, such as stainless steel. Sleeve 164 forms an internal bore 220 which coaxially aligns with the internal bore 210 of the spring, and bore 168 of body 152. In that way, a male pin may slide into the contact and through sleeve 164 to engage the fingers 200 of the spring 162 and bore 168 of the contact body for a secure electrical engagement. Referring to FIGS. 11 and 12, the tip end 180 of sleeve 164 is appropriately rolled inwardly and backwardly with respect to the sleeve 164 to guide a male pin into the contact and into the tapered ends 206 of the spring 162 for proper engagement. The inner diameter of bore 220 is the same as or slightly smaller than the outer diameter of the step section 161 to be secured to section 160 of the solid body. The rear end 178 of sleeve 164 abuts with the shoulder 176 of collar 174.

Turning now to FIGS. 12 and 13, to complete construction of contact 150, the spring 162 is slid over the solid contact body until the rear end 193 of the spring engages the section 166 of the contact body 152. The tongues 198 are slid or snapped into respective indentations 184 to secure the spring to the body. Then sleeve 164 is slid over the spring 162 and press fit onto step section 161 of the solid section 160 of body 152 of the contact. The smaller diameter of step section 163 provides clearance for sleeve 164 as shown in FIG. 13.

Because of the unique construction of the contact of the invention incorporating a plurality of inwardly radially extending and forwardly extending tongues 198 and discrete stamped indentations 184 without machining, a significant cost and time savings in realized with the invention. The spring may be secured without additional features being formed either within the spring 162 or the sleeve 164. As such, the construction of sleeve 164 eliminates various stamping and other processing steps associated with sleeve 164, thus further reducing the overall cost of manufacturing the contact 150.

Similarly, because of the unique formation of spring 162 that incorporates spring fingers 200 having wider dimensions at the base end 192 than at the tip end 204, the present contact eliminates the need for any particular features to be formed into sleeve 164 that would limit the travel of the spring fingers 200 to prevent over extension. Prior art contacts often require additional structures to prevent over extension or overflexing of the spring fingers 200.

Accordingly, the contact of the present invention as illustrated in FIGS. 10-14 provides a unique contact that may be cost-effectively produced with minimal formation steps but still achieves a robust construction and a solid electrical connection with a male pin of a mating contact.

The design of the present invention and the uniquely-shaped spring fingers enable the elastic deflection of the contact to be increased without the need for an over-flexed stopping device. Furthermore, the invention provides a unique securement of the spring with the contact body without requiring additional features to be formed either on the spring or on the sleeve for securing the spring with the contact body. These features and other features are provided by the contact as described and claimed herein. While the present invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. An electrical connector contact comprising:

a body having a conductor section for receiving a conductor and a pin section for receiving a male pin contact;

a spring configured for engaging the pin section and including a plurality of spring fingers positioned around the pin section for forming a bore, the spring fingers flexing radially inwardly for engaging a pin contact in engagement with the body;

a sleeve configured for engaging the body to overlie the spring;

the body including a plurality of discrete indentations formed at positions around the body and extending radially into the body;

the spring including a plurality of features extending radially inwardly in the bore and into the indentations for securing the spring with the body.

2. The electrical connector contact of claim 1 wherein the spring includes a base section and the spring fingers extending forwardly from the base section, the features extending forwardly from the base section for extending into the indentations.

3. The electrical connector contact of claim 1 wherein the spring includes a base section and the spring fingers extending forwardly with from the base section, the features extending rearwardly from the base section for extending into the indentations.

4. The electrical connector contact of claim 1 wherein the sleeve is configured for engaging a portion of the spring when it engages the body.

5. The electrical connector contact of claim 1 wherein the spring includes at least one spring finger having an asymmetrical shape with a wider base and more narrow tip.

6. The electrical connector contact of claim 1 further comprising a collar positioned rearwardly on the body from the pin section, the sleeve engaging the body and abutting against the collar.

7. The electrical connector contact of claim 1 wherein the sleeve extends over both ends of the spring.

8. The electrical connector contact of claim 1 wherein the body further includes a first step section positioned rearwardly of the pin section, the sleeve configured for engaging the first step section to overlie the spring.

9. The electrical connector contact of claim 8 wherein the body further includes a second step section positioned forwardly of the first step section, the second step section having an outer diameter smaller than the outer diameter of the first step section for providing clearance between the sleeve and spring.

10. An electrical connector contact comprising:

a body having a conductor section for receiving a conductor and a section for receiving a male pin contact;

a spring configured for engaging the body and including a plurality of spring fingers positioned around the body for forming a bore, the spring fingers flexing radially inwardly for securing a pin contact in engagement with the body;

a sleeve configured for engaging the body to overlie the spring;

the body including a plurality of indentations formed in the body and extending radially inwardly in the body at positions around the body;

the spring including a plurality of features extending radially inwardly in the spring and extending forwardly toward the spring fingers for engaging the respective indentations for securing the spring with the body.

11. The electrical connector contact of claim 10 wherein the sleeve is configured for engaging a portion of the spring when it engages the body.

12. The electrical connector contact of claim 10 wherein the sleeve engages at least one of the features of the spring for pushing the feature into a respective indentation.

13. The electrical connector contact of claim 10 wherein the body further includes a first step section and a second step section having a smaller outer diameter than the outer diameter of the first step section for providing clearance, the sleeve configured for engaging the first step section to secure the sleeve with the body.

14. The electrical connector contact of claim 10 wherein the spring includes at least one spring finger having an asymmetrical shape with a wider base and more narrow tip.

15. The electrical connector contact of claim 10 wherein the sleeve extends over both ends of the spring.

16. An electrical connector contact comprising:

a body configured for receiving a conductor and for receiving a pin contact;

a spring configured for engaging the body and including a plurality of spring fingers positioned for forming a bore, the spring fingers flexing radially inwardly for engaging a pin contact;

a sleeve configured for engaging the body to overlie the spring;

the spring including a plurality of tongues extending radially inwardly in the spring for engaging the body for securing the spring with the body;

the sleeve configured for engaging the plurality of tongues of the spring and pushing on the tongues for engagement with the body for securing the spring and providing electrical connection between the body and spring.

17. The electrical connector contact of claim 16 wherein the body includes a plurality of discrete indentations formed in the body and extending radially inwardly in the body at positions around the body;

the sleeve pushing the tongues into engagement with the discrete indentations for securing the spring.

18. The electrical connector contact of claim 16 wherein the spring includes a base section and the spring fingers extending forwardly from the base section, the plurality of tongues extending forwardly from the base section for engaging the body.

19. The electrical connector contact of claim 16 wherein the spring includes a base section and the spring fingers extending forwardly from the base section, the plurality of tongues extending rearwardly from the base section for engaging the body.

* * * * *